US009901187B2

(12) United States Patent
Burkholder et al.

(10) Patent No.: US 9,901,187 B2
(45) Date of Patent: Feb. 27, 2018

(54) MATTRESS AND BASSINET SUPPORT STRUCTURES FOR A CHILD CONTAINMENT DEVICE

(71) Applicant: GRACO CHILDREN'S PRODUCTS INC., Atlanta, GA (US)

(72) Inventors: Brandon Burkholder, Atlanta, GA (US); Matthew Rivera, Mableton, GA (US); Annette Stella, Dowington, PA (US)

(73) Assignee: GRACO CHILDREN'S PRODUCTS INC., Atlanta, GA (US)

( * ) Notice: Subject to any disclaimer, the term of this patent is extended or adjusted under 35 U.S.C. 154(b) by 0 days.

(21) Appl. No.: 14/170,216

(22) Filed: Jan. 31, 2014

(65) Prior Publication Data

US 2014/0208505 A1 Jul. 31, 2014

Related U.S. Application Data

(60) Provisional application No. 61/840,994, filed on Jun. 28, 2013, provisional application No. 61/759,322, filed on Jan. 31, 2013.

(51) Int. Cl.

| | |
|---|---|
| ***A47D 13/06*** | (2006.01) |
| ***A47D 7/00*** | (2006.01) |
| ***A47D 9/00*** | (2006.01) |

(52) U.S. Cl.

CPC ..... *A47D 13/061* (2013.01); *A47D 7/002* (2013.01); *A47D 9/005* (2013.01); *A47D 13/06* (2013.01); *A47D 13/063* (2013.01)

(58) Field of Classification Search

CPC ..... A47D 9/00; A47D 9/005; A47D 13/06; A47D 13/061; A47D 13/063; A47D 13/066; A47D 13/068; A47D 11/007; A47D 15/001; A47D 7/002; A47D 7/00

See application file for complete search history.

(56) References Cited

U.S. PATENT DOCUMENTS

| | | | | |
|---|---|---|---|---|
| 5,349,709 | A * | 9/1994 | Cheng | A47D 7/03 5/93.1 |
| 5,778,465 | A * | 7/1998 | Myers | 5/99.1 |
| 6,131,218 | A * | 10/2000 | Wang | 5/93.1 |
| 6,434,767 | B1 * | 8/2002 | Welsh, Jr. | 5/93.2 |
| 6,438,773 | B1 * | 8/2002 | Hsia | 5/99.1 |
| 8,677,533 | B2 * | 3/2014 | Barron et al. | 5/655 |
| 2006/0253978 | A1 * | 11/2006 | Paesang et al. | 5/93.1 |
| 2006/0253980 | A1 * | 11/2006 | Paesang et al. | 5/99.1 |

(Continued)

*Primary Examiner* — David E Sosnowski
*Assistant Examiner* — David R Hare
(74) *Attorney, Agent, or Firm* — Eversheds Sutherland (US) LLP

(57) ABSTRACT

A child containment device has a playard and a bassinet accessory supported on the playard. A mattress is positioned within the bassinet accessory. The device can have a mattress support structure attached to the bassinet accessory or the mattress and can have a bassinet support structure attached to the bassinet accessory. The mattress support structure can keep the mattress flat and level and be irremovably attached to the mattress or bassinet accessory. The bassinet support structure can be irremovably attached to the bassinet accessory or can be configured to orient the mattress to contact a playard floor panel or be oriented 30° or more from a level orientation if improperly installed.

15 Claims, 24 Drawing Sheets

(56) References Cited

U.S. PATENT DOCUMENTS

| | | | | |
|---|---|---|---|---|
| 2007/0214576 | A1* | 9/2007 | Espenshade | 5/723 |
| 2008/0271243 | A1* | 11/2008 | Burkholder et al. | 5/93.2 |
| 2010/0138991 | A1* | 6/2010 | Hartenstine et al. | 5/99.1 |
| 2011/0197358 | A1* | 8/2011 | Bu | A47D 7/04 5/93.1 |
| 2011/0283457 | A1* | 11/2011 | Son et al. | 5/690 |
| 2012/0233770 | A1* | 9/2012 | Greger | A47D 9/00 5/98.1 |
| 2013/0117930 | A1* | 5/2013 | Hsu | 5/93.1 |
| 2013/0221302 | A1* | 8/2013 | Cheng | A47D 13/063 256/25 |
| 2014/0165288 | A1* | 6/2014 | Wang | A47D 7/04 5/99.1 |

* cited by examiner

250

MATTRESS AND BASSINET SUPPORT STRUCTURES FOR A CHILD CONTAINMENT DEVICE

RELATED APPLICATION DATA

This patent is related to and claims priority benefit of U.S. provisional application Ser. Nos. 61/759,322 filed Jan. 31, 2013 and 61/840,994 filed Jun. 28, 2013, each of which are entitled "Mattress and Support Structure for a Child Containment Device. The entire content of these prior filed provisional applications are hereby incorporated herein by reference.

BACKGROUND

1. Field of the Disclosure

The present disclosure is generally directed to child containment devices, and more particularly to a mattress support and a support structure for same with features to attain various performance improvements of the mattress, a playard and/or a bassinet accessory for the playard.

2. Description of Related Art

Playards and bassinets are child containment devices that are known in the art. Bassinets are known to be provided for mounting on a playard with the bassinet sleeping surface elevated above the playard bottom panel. Such a bassinet can provide an elevated sleeping surface in a playard for infants. The higher elevation of the bassinet surface positions an infant closer to a parent or caregiver. This makes it easier for the person to reach and attend to an infant in the bassinet, pick the infant up from the bassinet, or place the infant in the bassinet.

Bassinet accessories designed for use on playards typically are meant for young infants that cannot yet roll over under their own power. Playards and bassinet accessories are often used as sleeping environments for young infants. A child sleeping in such a containment device may be left unsupervised for extended periods of time, which may exacerbate any preexisting problems with the equipment or structures. Problems may arise if the bassinet accessory and/or mattress support structure are not properly installed before placing an infant on the bassinet sleeping surface. The bassinet or mattress support structure may sometimes be assembled incorrectly or even without one or more of the support structures. This may render the sleeping surface non-flat or place the sleeping surface in an unlevel condition. Such an arrangement may increase the risk of breathing and/or other difficulties for the child.

Typical bassinet accessories have a fabric bassinet structure with a bottom panel and surrounding side walls. Many of these products utilize tubes that are slid through fabric tunnels at the tops of the side walls. The tubes connect to the playard top rails or corner posts to mount the bassinet accessory to the playard. A caregiver may mistakenly mount the bassinet accessory incorrectly by not attaching an end of a tube to the playard or by not even installing one of the tubes. Depending on the structure of the bassinet accessory, the structure may look normal to the caregiver when it is incorrectly installed.

A typical playard is folded up when not in use. The playard often folds up to a generally rectangular shape. The mattress is then wrapped around the folded up structure to create a rectangular box-like configuration that is easy to carry, transport, and stow away. On most playards, the bassinet accessory must be removed from the playard before the playard is folded up. The bassinet accessory and its support and mounting components must then be broken down, folded up, and stored or stowed, sometimes with the folded up playard and sometimes separately. The support structure components of the bassinet accessory are often separate from the bassinet soft goods. The components must then be managed separately from the bassinet soft goods as well. The components can become easily lost or misplaced, making it impossible to properly install the bassinet accessory.

SUMMARY

A child containment device has a playard and a bassinet accessory supported on the playard. A mattress is positioned within the bassinet accessory. The device can have a mattress support structure attached to the bassinet accessory or to the mattress and can have a bassinet support structure attached to the bassinet accessory. The mattress support structure can keep the mattress flat and level and can be irremovably attached to the mattress or bassinet accessory. At least part of the bassinet support structure can be irremovably attached to the bassinet accessory or can be configured to either orient the mattress to contact a playard floor panel or be oriented 30° or more from a level orientation if improperly installed.

In one example according to the teachings of the present disclosure, a child containment device has a playard, a bassinet accessory with a bottom panel and connected to the playard, and a mattress having a top side defining a sleeping surface and positioned over the bottom panel of the bassinet accessory. A mattress support structure is coupled to the bottom panel of the bassinet accessory and underlies the mattress. The child containment device can be folded up to a compact storage size and shape with the bassinet accessory still connected to the playard. When the child containment device is folded up, the mattress support structure folds up and fits entirely within dimensions of the compact storage size and shape of the folded up child containment device.

In one example, the mattress support structure can have two elongate stiffeners irremovably attached to the bottom panel of the bassinet accessory.

In one example, the mattress support structure can have two elongate stiffeners attached to the bottom panel of the bassinet accessory. Each stiffener can have two or more segments that can engage one another and be disengaged from one another.

In one example, the mattress support structure can have two elongate stiffeners attached to the bottom panel of the bassinet accessory. Each stiffener can have two or more segments and each of the two or more segments can be irremovably attached to the bottom panel.

In one example, the mattress support structure can have at least two elongate stiffeners fastened to the bottom panel.

In one example, the mattress support structure can have at least two elongate stiffeners. Each elongate stiffener can have a portion received in a fabric tunnel that is affixed to the bottom panel and the portion can be fastened to the fabric tunnel.

In one example, the mattress support structure can have at least two elongate stiffeners. A portion of each stiffener can be received in a fabric tunnel on the bottom panel of the bassinet accessory. Each fabric tunnel can have a distal open end and a free end of the portion of each of the at least two elongate stiffeners can slide through the distal open end when the child containment device is folded up.

In one example, the mattress support structure can have at least two elongate stiffeners. A portion of each stiffener can be received in a fabric tunnel on the bottom panel of the bassinet accessory. Each fabric tunnel can have a distal closed end. A free end of the portion of each of the at least two elongate stiffeners 1) can be spaced a first distance from the distal closed end of the corresponding fabric tunnel when the child containment device is in an in-use condition, and 2) can be spaced a second distance closer than the first distance to the distal closed end when the child containment device is folded up.

In one example, the mattress support structure can have at least two elongate stiffeners. Each of the at least two elongate stiffeners can have two end segments that can be fastened to the bottom panel and can have a central segment that can be fastened to the bottom panel. The two end segments can engage opposite ends of the respective central segment in an in-use arrangement and can be disengaged from the opposite ends of the respective central segment when the child containment device is folded up.

In one example, the mattress support structure can have at least two elongate stiffeners. Each of the at least two elongate stiffeners can have two end segments that can be fastened to the bottom panel and can have a central segment that can be fastened to the bottom panel. Each of the end segments can have a portion received in a fabric tunnel connected to the bottom panel.

In one example according to the teachings of the disclosure, a child containment device has a playard, a bassinet accessory supported on the playard, a mattress positioned within the bassinet accessory, and a mattress support structure attached to the bassinet accessory. The mattress support structure includes at least one elongate stiffener connected to the playard. The at least one elongate stiffener is irremovably attached to the bassinet accessory.

In one example, the at least one elongate stiffener can be fastened to the bassinet accessory.

In one example, the at least one elongate stiffener can have a portion received in and fastened to a fabric tunnel connected to the bassinet accessory.

In one example, the at least one elongate stiffener can include two stiffeners arranged spaced apart from one another on an underside of the mattress. Each of the two stiffeners can have opposed free ends received in and fastened to a different fabric tunnel connected to a bottom panel of the bassinet accessory.

In one example, the mattress can have a length and a width that is less than the length. The at least one elongate stiffener can have two stiffener segments that can engage one another and extend lengthwise along the mattress in an in-use arrangement and that can be disengaged from one another whereby each stiffener segment can be rotated to a stowed position extending widthwise across the mattress.

In one example, the mattress can have a plurality of mattress portions that can be connected to one another along widthwise extending mattress fold joints. The at least one elongate stiffener can have two stiffener segments that can engage one another in an in-use arrangement and extend lengthwise along the mattress. The two stiffener segments, when in a stowed position, can be parallel with the mattress fold lines allowing the mattress to be folded up.

In one example according to the teachings of the disclosure, a child containment device has a playard, a bassinet accessory having a bottom panel, a mattress defining a sleeping surface and sized to fit within the bassinet accessory on the bottom panel, and a bassinet support structure attached to the bassinet accessory. The bassinet support structure includes at least one stiffener connected to the bassinet accessory and to the playard. When the bassinet support structure is correctly assembled and connected correctly to the playard, the sleeping surface of the mattress is held at a level orientation. When the bassinet support structure is misassembled or incorrectly connected to the playard, the sleeping surface of the mattress is oriented at an angle of 30° or more relative to the level orientation.

In one example, the at least one stiffener can have at least two tube segments that can be tethered to one another.

In one example, the at least one stiffener can have at least two tube segments that can be tethered to one another in series by a webbing.

In one example, the bassinet support structure can have at least two stiffeners that can be loosely tethered to one another by a webbing material that can be fastened to each of the two stiffeners.

In one example, the bassinet support structure can have at least two stiffeners that can be loosely tethered to one another by a webbing material that can be fastened to each of the two stiffeners. The at least two stiffeners can be received through one or more fabric tunnels on the bassinet accessory.

In one example, one or more fabric tunnels can be located at a top of a side wall of the bassinet accessory. The at least one stiffener can be received in the one or more fabric tunnels.

In one example according to the teachings of the disclosure, a child containment device has a playard, a bassinet accessory supported on the playard, a mattress defining a sleeping surface and positioned within the bassinet accessory, and a bassinet support structure attached to the bassinet accessory. The bassinet support structure includes at least one elongate stiffener connected to the playard. The at least one elongate stiffener is irremovably attached to the bassinet accessory.

In one example, the at least one elongate stiffener can be fastened to the bassinet accessory.

In one example, the at least one elongate stiffener can have a portion received in and fastened to a fabric tunnel connected to the bassinet accessory.

In one example, the at least one elongate stiffener can include a plurality of stiffeners. Each of the plurality of stiffeners can be received at least partly through and can be fastened to a fabric tunnel connected to a side wall of the bassinet accessory.

BRIEF DESCRIPTION OF THE DRAWINGS

Objects, features, and advantages of the present invention will become apparent upon reading the following description in conjunction with the drawing figures, in which.

DETAILED DESCRIPTION OF THE DISCLOSURE

Figure 1:
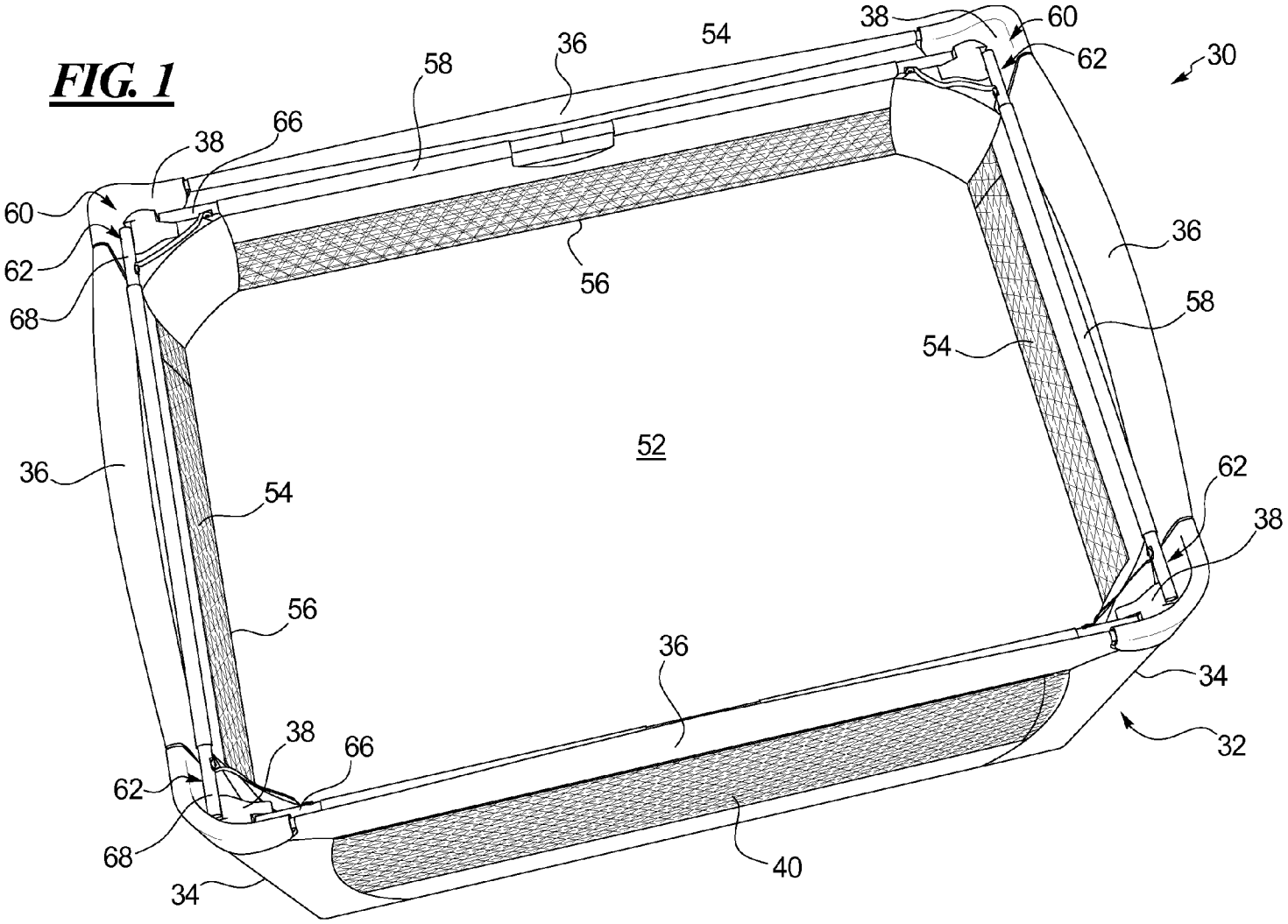
FIG. 1 shows a top perspective view of one example of a playard and bassinet accessory combination with a bassinet support structure constructed in accordance with the teachings of the present disclosure and in an in-use condition.

The disclosed child containment devices solve or improve upon one or more of the above-noted and/or other problems and disadvantages with prior known child containment devices. The disclosed child containment devices in some examples address the bassinet support or mounting structure. The disclosed child containment devices in other examples address the mattress support structure regarding mattress flatness. The disclosed child containment devices in some examples address both issues. The aforementioned problems and disadvantages may be solved or addressed by making the bassinet accessory or the mattress or both unusable when one key structural element is left out of its assembly or is not attached to the playard, bassinet accessory, or mattress, or is missing entirely. This aspect of the disclosure is termed "missing key structural element" or MKSE herein. The aforementioned problems and disadvantages may also be solved or improved upon by making the key structural elements a permanently attached part of the structure.

At least one of these solutions will soon be required to be met as part of a government standard for playard and bassinet accessory combinations. The problems are covered by addressing the bassinet accessory structural supporting elements in two different standards: Playards and Bassinets/Cradles. The MKSE term is said to include all rods, tubes, bars, and hooks that support the bassinet accessory or that were used in assembling the bassinet accessory. The MKSE term is to include structures that attach the bassinet to the playard, but also is to encompass the mattress support rods and other structures that support the bassinet accessory mattress in order to keep the sleep surface flat and stable. Any issues dealing with misassembled parts of the mattress support rods are to be addressed in the bassinet standard. Thus, both ASTM subcommittees (Playard and Bassinet) agreed that: (1) The playard standard, ASTM F406-13, will address safety issues related to bassinet accessory attachment components (i.e., structures that attach the bassinet accessory to the playard); and (2) the bassinet standard, ASTM F2194-13, will address mattress support rods (and all other structures that keep the bassinet accessory mattress flat and stable) through the segmented mattress flatness test contained in the bassinet standard.

Many known existing playard and bassinet accessory combinations will likely not meet the new "Safety Standard for Play Yards." The Safety Standard incorporates by reference ASTM F406-13, "Standard Consumer Safety Specification for Non-Full-Size Baby Cribs/Play Yards." For a product to be in compliance the ASTM MKSE requirement: 1) when a support element is removed, bassinets or sleeping surfaces must fall to a playard floor or tilt at an angle of greater than 30° from the horizontal; or 2) any structural elements or support structures must be permanently attached to part of the child containment device, such as the mattress or the bassinet accessory, in order to obviously render the device incapable of supporting an infant when one or more pieces of the support structure are missing or not yet assembled.

Besides the compliance requirement, other considerations are important to a caregiver when storing or stowing a playard and a bassinet accessory and when assembling and using a playard and a bassinet accessory as a sleeping environment for a baby. Such considerations can be cost, packaging for sale, packaging for consumer storage, ease of use, and safety. Another such consideration can be that the entire combination of the playard and bassinet accessory be foldable as a unit. This can be so without having to remove the bassinet accessory before folding up the playard and while still meeting the MKSE standards and requirements.

A user must be able to easily and readily determine and identify when a mattress support structure component is missing or not yet assembled. A product is in compliance with ASTM MKSE requirement when a bassinet or sleeping surface either collapses or tilts at greater than 30° even if just one structural element is removed or not yet connected, or when the structural elements of a product are permanently attached to a bassinet bottom. The disclosed child containment devices address one or more of these compliance requirements.

A number of different child containment device examples are disclosed and described herein. Where appropriate, like reference numbers are used to identify like or substantially similar parts among the different embodiments. Different reference numbers are used to identify similar parts among the different examples where the parts have a difference that is substantial or significant in the context of the present disclosure.

Turning now to the drawings, FIGS. 1-4 show one example of a child containment device 30 constructed in accordance with the teachings of the present invention. In this example, the child containment device 30 has a playard 32 with a frame assembly that has four corner posts 34, four top rails 36, and four corner brackets 38. The playard 32 also has a floor surface or panel (not shown) and a bottom frame structure (not shown) beneath and/or surrounding the bottom panel. The playard 32 also has a lock and release system (not shown) that can retain the playard in the in-use configuration or condition of FIG. 1 or permit the playard to be folded up to a compact storage configuration or condition. The playard 32 also has four upstanding side walls 40 formed of fabric or mesh that are supported by the respective top rails 36 and between the corner posts 34. An open interior is defined above the floor panel and within the side walls.

The corner posts 34 and top rails 36 are joined to one another at the corner brackets 38 and the corner posts and the bottom frame structure are joined to one another so that the frame assembly forms a rectangular shaped box-like structure with an open top in an in-use configuration. The structure and function of the playard 32 is known in the art. The configuration and construction of the playard 32 can vary considerably from the examples shown herein while still functioning as intended in accordance with the teachings of the present invention. Details of the playard 32 are thus not otherwise described herein except where needed to describe a specific aspect of the disclosed child containment devices.

The child containment device 30 also has a bassinet accessory 50 connected to or supported by the playard 32. The bassinet accessory 50 has a rectangular fabric bed that is sized and shaped to fit within the open interior of the playard and in this example to closely match the shape of the playard. The fabric bed has a bottom panel 52 that is supported in an elevated position above the floor panel of the playard 32 in the in-use configuration of FIG. 1. The fabric bed also has four side panels 54 that are connected to the respective perimeter edges 56 of the bottom panel 52. Each of the side panels 54 has an elongate fabric tunnel 58 provided at and along its upper edge. The fabric bed can be formed as a sewn together fabric structure using methods, techniques, arrangements, and materials that are known in the art.

Figure 2:
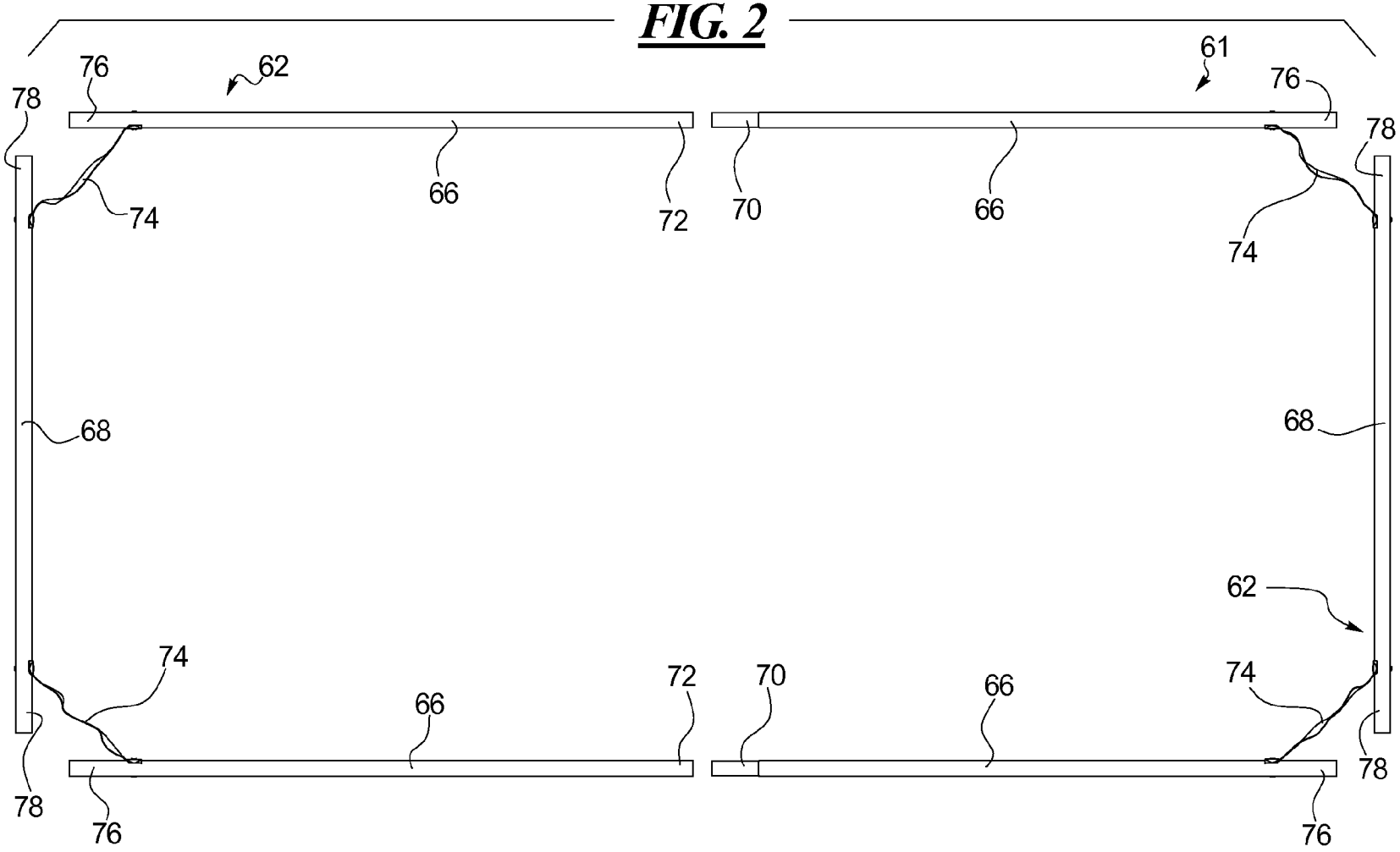
FIG. 2 shows a plan view of one example of the bassinet support structure for the bassinet accessory of FIG. 1 and constructed in accordance with the teachings of the present disclosure.
Figure 3:
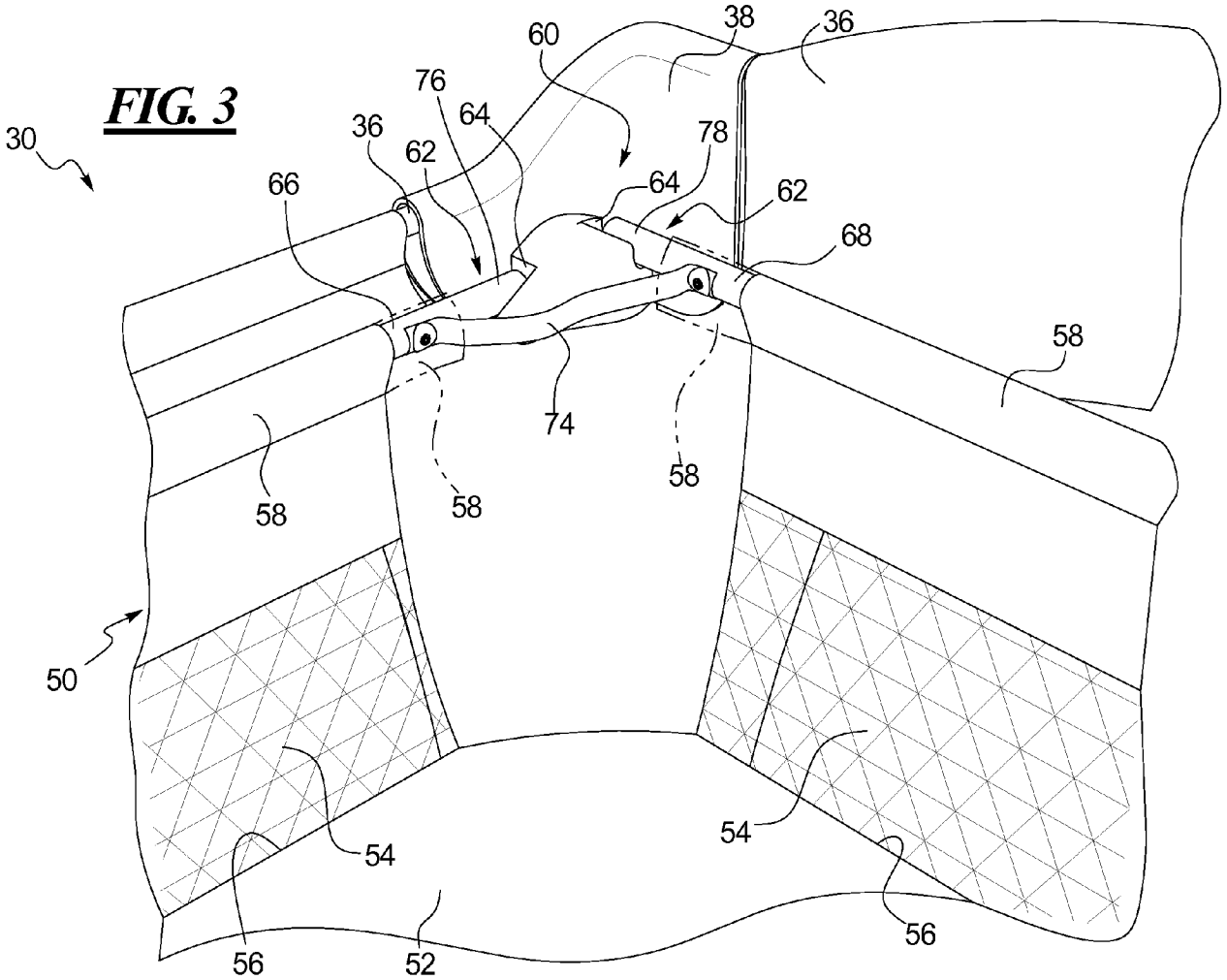
FIG. 3 shows an inside perspective view of one corner of the playard and bassinet accessory combination and the bassinet support structure of FIGS. 1 and 2.

As shown in FIGS. 2 and 3, the bassinet accessory 50 has a bassinet support structure 60 with a support 61 having a plurality of elongate stiffeners 62 and a plurality of receivers or connectors 64 provided on the playard 32. The receivers 64 are generally configured for connecting the stiffeners 62 to the playard. In this example, the corner brackets 38 each define two receivers 64 for connecting the support 61 to the playard. Specifically, each receiver 64 in this example is a saddle or U-shaped receptacle formed on one of the corner brackets 38. Each receiver 64 is upwardly open and can have a shape to require the stiffeners 62 to be snapped or popped into the receivers to assist in retaining the engaged or assembled connection.

In this example, each stiffener 62 of the support 61 is a tube structure with three tube segments including a pair of spaced apart side segments 66 and an end segment 68 extending between the side segments, as shown in FIG. 2. A free end 70 of each side segment 66 on one of the tube structures is configured to engage and connect to a free end 72 on a corresponding side segment 68 of the other tube structure. In this example, the free ends 70 are swaged or tapered down in diameter to fit within the larger diameter free ends 72. A locking device, such as a VALCO ball arrangement (not shown) can be used to releasably secure the tube segment free ends 70, 72 together when the bassinet accessory 50 is assembled. Other arrangements and mechanisms can be used to releasably secure the side segments 66 together.

In this example, the three tube segments 66, 68 of each stiffener 62 are tethered together with the end segment positioned between the two side segments as shown in FIG. 2. A webbing or strap 74 is fastened to the opposite ends 76 of the side segments 66 and to the ends 78 of the end segment 68. In one example, the webbing 74 can be secured to each segment using a rivet or other suitable fastener. By tethering the tube segments 66, 68 together in series, the support 61 is modified from having six separate tube segments to having only two separate tube structures or components. When assembling the bassinet support structure 60, the user will be much less likely to forget to install one of the tethered tube segments than they would be to forget to install one of six separate tube segments.

In this example, the bassinet support structure 60 is assembled by first installing the tube segments 66, 68 in the fabric tunnels 58 on the side panels 54 of the fabric bed. The side segments 66 of each tube structure are slide into the fabric tunnels 58 and then the respective free ends 70, 72 are joined and engaged. The bassinet support structure, once installed, leaves the opposite ends 76 of the side segments 66 and the ends 78 of the end segments 68 exposed beyond the fabric tunnels. The exposed ends 76, 78 are then inserted into the receivers 64 on the corner brackets, as depicted in FIG. 1.

Figure 4:
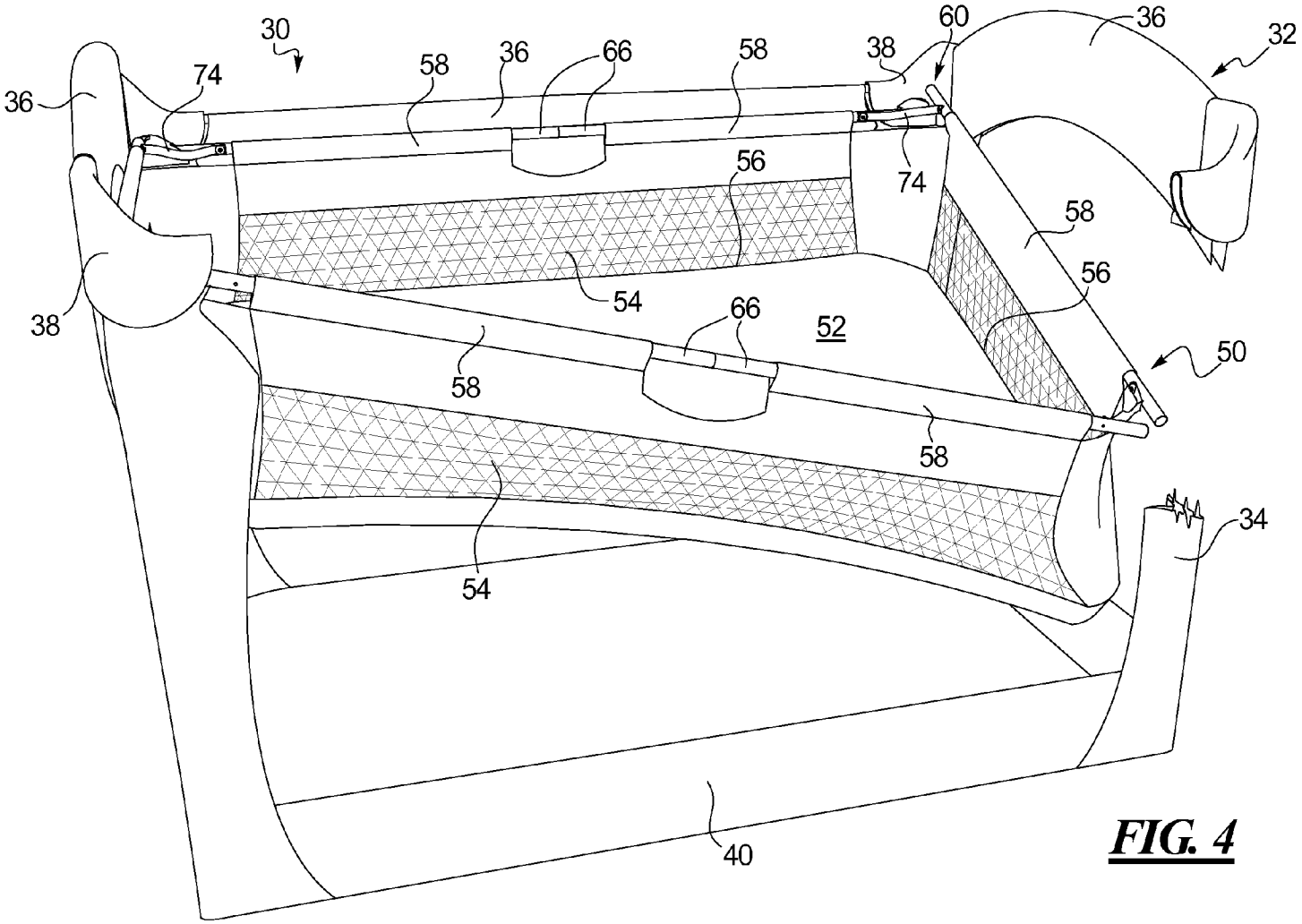
FIG. 4 shows a perspective and partial cut-away view of the playard and bassinet accessory combination of FIG. 1, but with one corner of the bassinet support structure detached from the playard.

The bassinet support structure 60 is configured so that it will be clear to the user if they do not correctly attach one corner of the support 61 to the playard 32. As shown in FIG. 4, the playard bottom panel 52 will tilt or drop down to an angle of 30° or greater relative to a level orientation. The level orientation can be a reference orientation where the bottom panel 52 is above and parallel with the floor or the playard floor panel. The webbing 74 can be elastic or can be lengthy enough that, even if the user only misassembles one of the tube segments 66 or 68 at a corner bracket 38, the bottom panel 52 will still drop sufficiently, as shown in FIG. 4.

Figure 5:
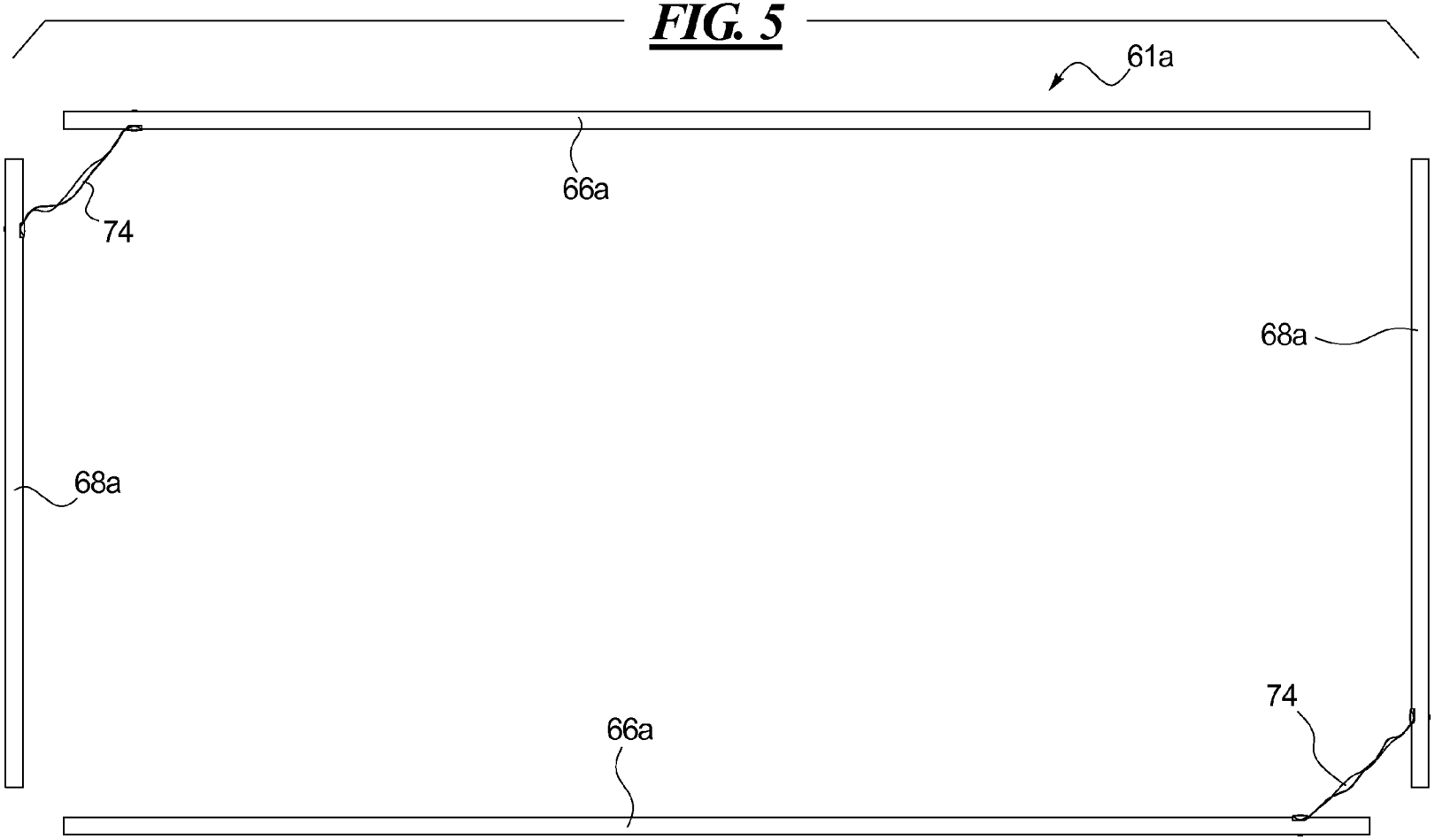
FIG. 5 shows a plan view of another example of a bassinet support structure for the playard and bassinet accessory of FIG. 1 and constructed in accordance with the teachings of the present disclosure.

The support 61 can be varied from the example shown in FIG. 2. For example, a continuous tether can be run through or be attached to portions of the side segments and can run through the entire end segment 68 to tether the segments together. The tube segments can be rods, bars, stiff straps, flat straps, or other types of substantially stiff structures. The stiffeners should be capable of supporting the bassinet accessory 50 and retaining its shape during use. FIG. 5 shows another example where a support 61*a* has two tube structures but only four tube segments include two side segments 66*a* and two end segments 68*a*. One side segment 66*a* and one end segment 68*a* are joined in series at one corner of the support 61*a* by a webbing 74 or strap.

Figure 6:
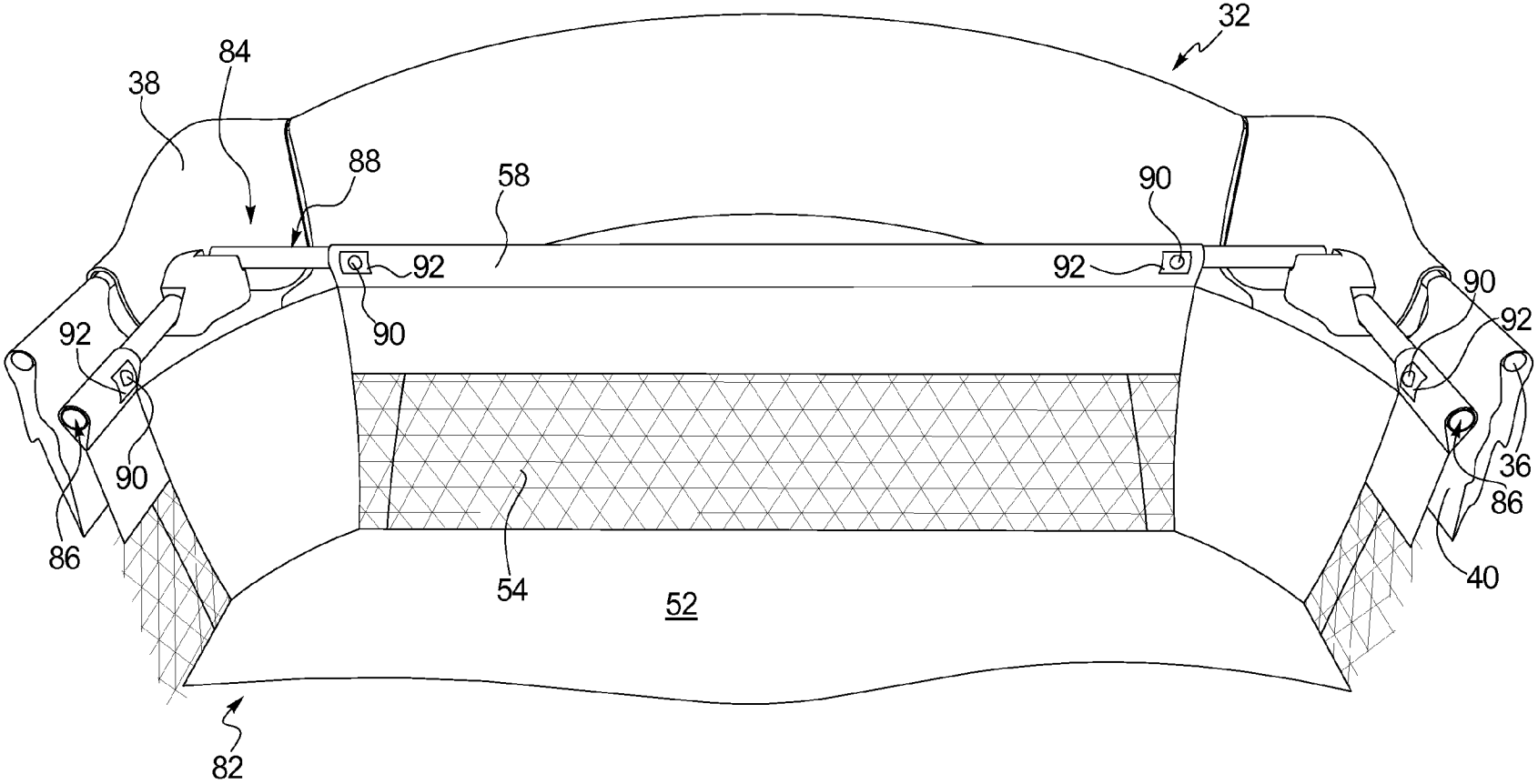
FIG. 6 shows an inside perspective view of one end of another example of a playard and bassinet accessory combination with a bassinet support structure constructed in accordance with the teachings of the present disclosure and in an in-use condition.
Figure 7:
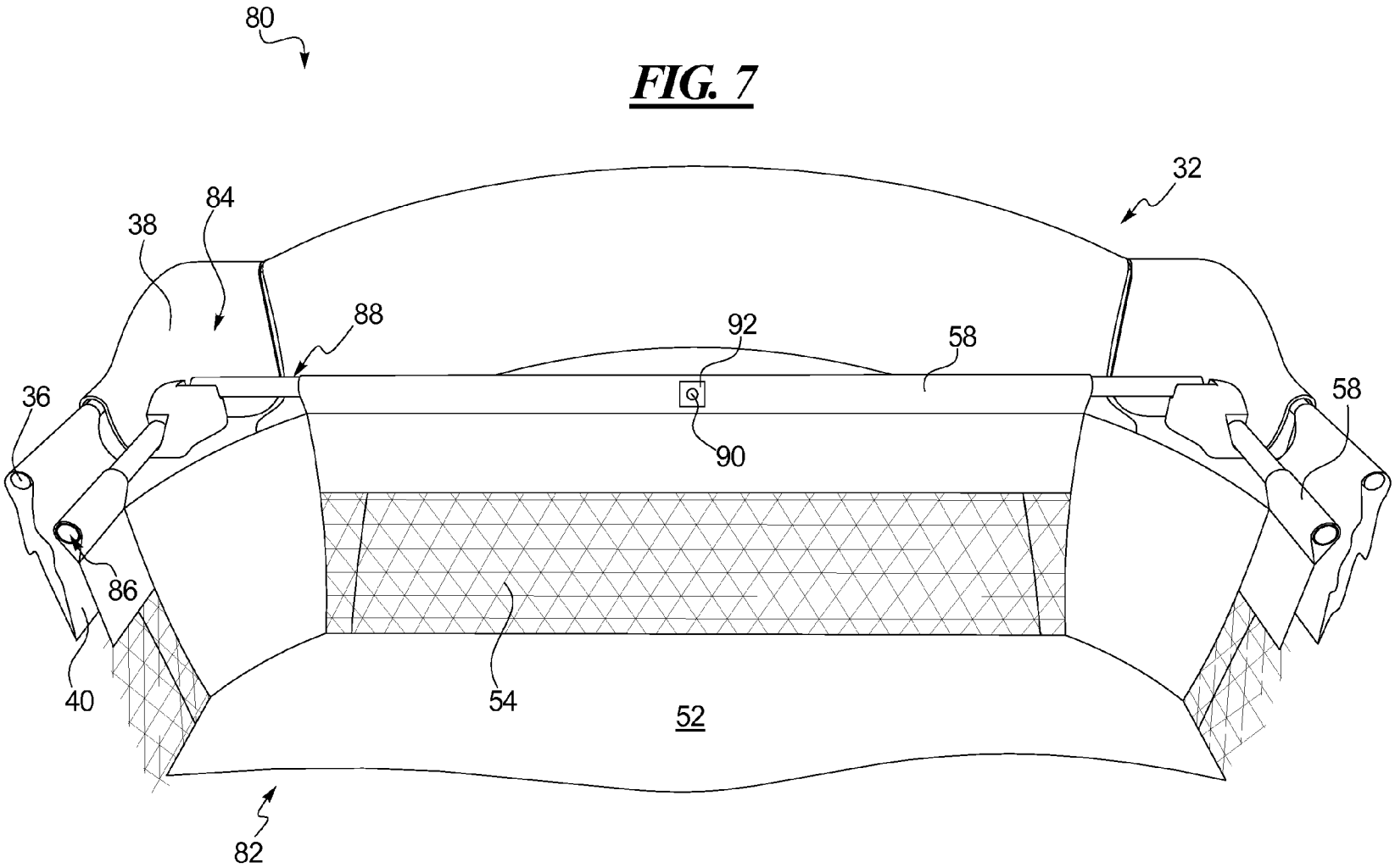
FIG. 7 shows an inside perspective view of one end of a playard and bassinet accessory combination with another example of a bassinet support structure similar to FIG. 6 and constructed in accordance with the teachings of the present disclosure.
Figure 8:
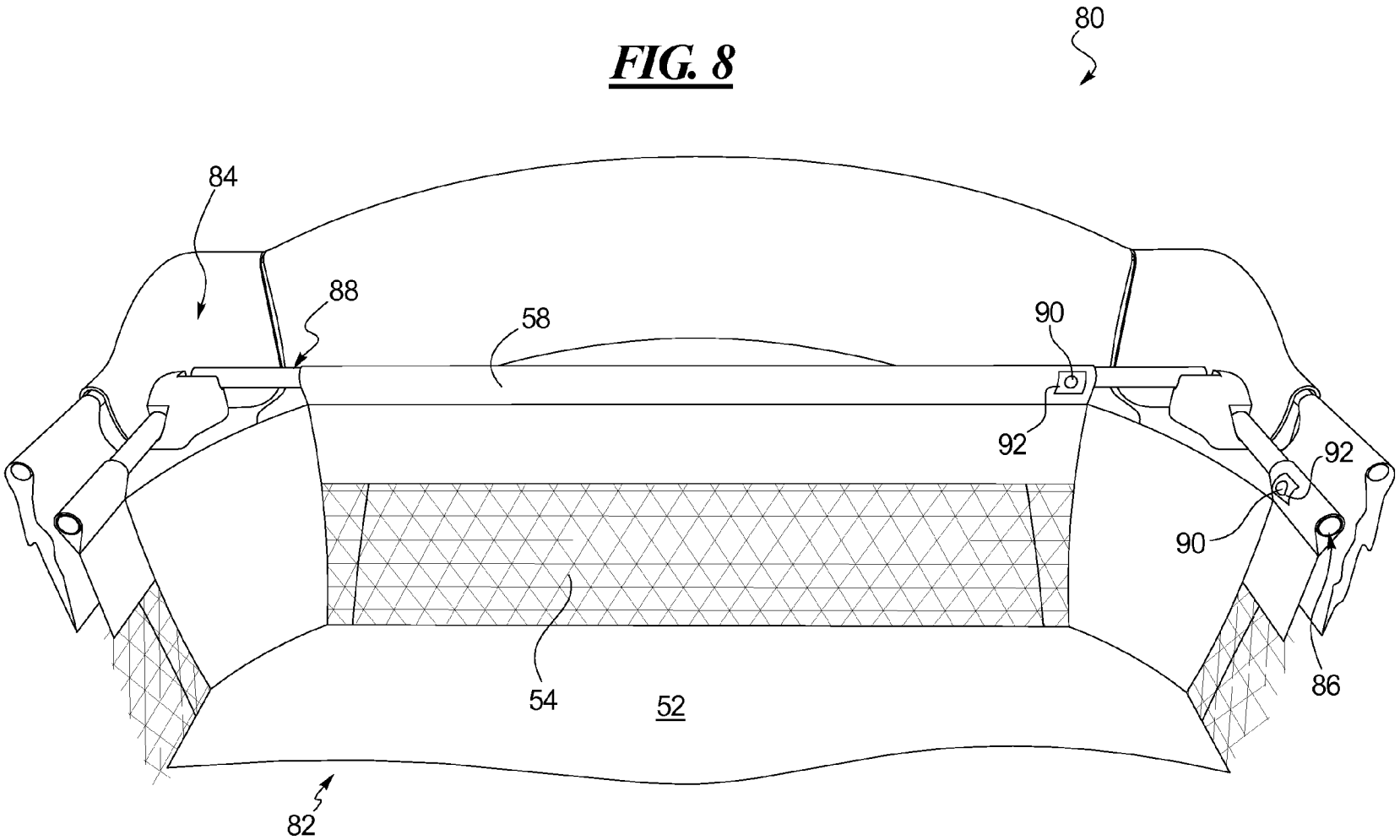
FIG. 8 shows an inside perspective view of one end of a playard and bassinet accessory combination with another example of a bassinet support structure similar to FIGS. 6 and 7 and constructed in accordance with the teachings of the present disclosure.

FIGS. 6-8 show another example of a child containment device 80 constructed in accordance with the teachings of the present invention. In this example, the child containment device 80 has a playard 32 that can be identical to or different from the earlier described playard of FIG. 1. In this example, the child containment device 80 also has a bassinet accessory 82 with a fabric bed having a bottom panel 52, side panels 54, and fabric tunnels 58 along the top edges of the side panels. A bassinet support structure 84 in this example has a support with a plurality of separate tube segments including side segments 86 and end segments 88. The tube segments are inserted in the fabric tunnels 58 leaving exposed ends 76 of the side segments 86 and exposed ends 78 of the end segments 88 beyond the fabric tunnels. The exposed ends 76, 78 are connected to the receivers 64 on the corner brackets 38 to assemble the bassinet accessory 82 to the playard 32.

In this example, the support is irremovably or permanently attached to the bassinet accessory 82. In one example as shown in FIG. 6, a rivet 90 or other suitable fastener can be used to attach the fabric tunnel 58 at each end to the respective tube segment 86 or 88. Thus, at least two rivets 90 are used in this example to irremovably attach the tube segments 86, 88 to the fabric tunnel 58. Each rivet 90 or other fastener can be supported by a protective washer 92 between a head of the rivet and the fabric material to prevent or inhibit tearing of the fabric. In this example, the tube segments 86, 88 are not easily removed from the bassinet accessory. The term irremovably attached is intended to mean that the ordinary user of the product will recognize that the tube segments are to remain attached to the fabric bed. Of course the tube segments could be removed by cutting fabric material or destroying or removing the rivets or other suitable fasteners. However, irremovably attached means that the attachment is intended to be permanent for the life of the product without having to use more than ordinary means to forcibly destroy or physically break and part the structure.

FIG. 7 shows one alternative example where each tube segment 86, 88 is irremovably attached to the fabric tunnels 58 by only one rivet 90 located at the center of each fabric tunnel and tube segment. FIG. 8 shows another alternative example where each tube segment 86, 88 is irremovably attached to the fabric tunnels 58 by only a single rivet 90 located at one end of each tube segment and tunnel. Other arrangements are permissible within the scope of the disclosure. The tube segments 86, 88 can also be replaced by other suitable stiffeners, if desired. Also, other mechanisms and devices can be used to create the irremovable or permanent attachment of the stiffeners to the bassinet fabric bed.

FIGS. 9-12 show one example of a mattress 100 for a bassinet accessory and/or for a playard. In this example, the mattress 100 has a mattress support structure 102 that is irremovably attached to the mattress. In this example, the mattress 100 can have a mostly conventional construction with four mattress portions or segments 104 connected to one another along fold lines or joints 106 as is known in the art. The mattress 100 has a top side 108 (see FIG. 12) defining a sleeping surface for a child or infant and has an underside 110 that contacts a playard floor panel or a bassinet bottom panel during use. The mattress 100 also has a perimeter with two side edges 112 and two end edges 114, which define a generally rectangular mattress shape or footprint. The mattress 100 thus has a length in a lengthwise direction along the side edges 112 and a width in a widthwise direction along the end edges 114.

Figure 9:
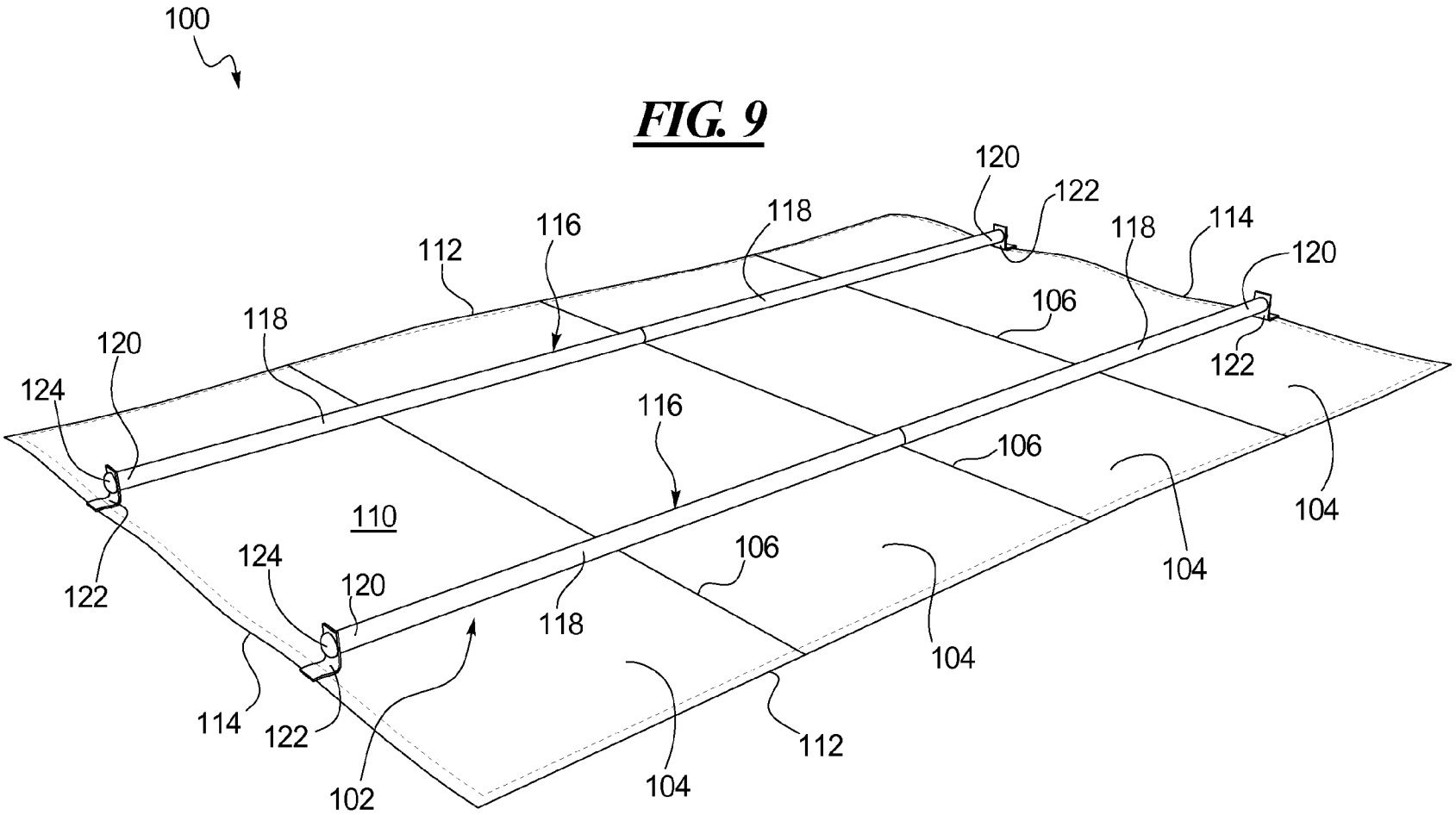
FIG. 9 shows a perspective underside view of one example of a mattress for a playard and bassinet accessory combination and constructed in accordance with the teachings of the present disclosure, the mattress having mattress supports permanently attached to the mattress and the mattress supports depicted in an engaged arrangement and an in-use position.
Figure 10:
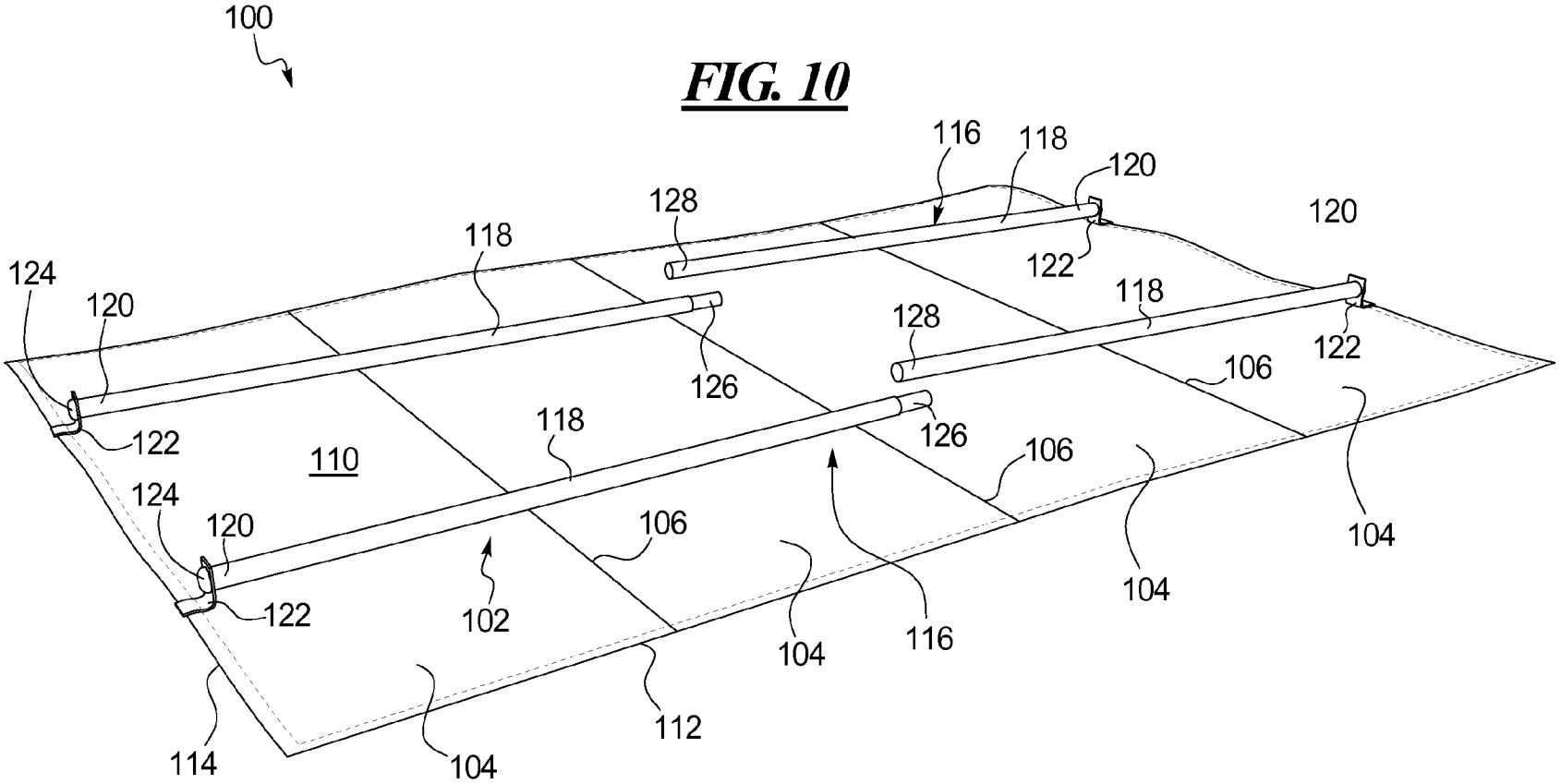
FIG. 10 shows the mattress of FIG. 9 but with the mattress supports in a disengaged arrangement but still in the in-use position.

As shown in FIGS. 9 and 10, the mattress support structure 102 has two spaced apart stiffeners 116 arranged lengthwise along the underside 110 of the mattress 100. In this example, each stiffener 116 is a tube with two tube segments 118. A distal end 120 of each tube segment 118 is irremovably attached to the mattress at or near the respective end edge 114. A fabric tab 122 is sewn or otherwise attached to the mattress end edge 114 for each of the tube segments 118. The distal end 120 of each tube segment is fastened to the corresponding tab 122 using a fastener 124 joined to the tube end. The type of fastener used can vary as long as the attachment or connection is irremovable or permanent within the context of this disclosure.

A shown in FIG. 10, one of the tube segments 118 of each stiffener 116 has a proximal end 126 that is swaged or tapered to a diameter that is smaller than the diameter of the proximal ends 128 of the other tube segments 118 of the stiffeners. When the mattress support structure 102 is assembled as shown in FIG. 9, the smaller swaged ends 126 are received in the larger ends 128 to engage and connect the tube segments 118 of the stiffeners 116. The stiffeners 116 extend lengthwise along the mattress in this in-use arrangement or assembled condition. When the mattress support structure 102 is disassembled, the tube segments are separated at the proximal ends 126, 128 as shown in FIG. 10. The proximal ends 126, 128 can include a suitable locking mechanism, such as a VALCO ball arrangement, to releasably secure the tube segments 118 together.

Figure 11:
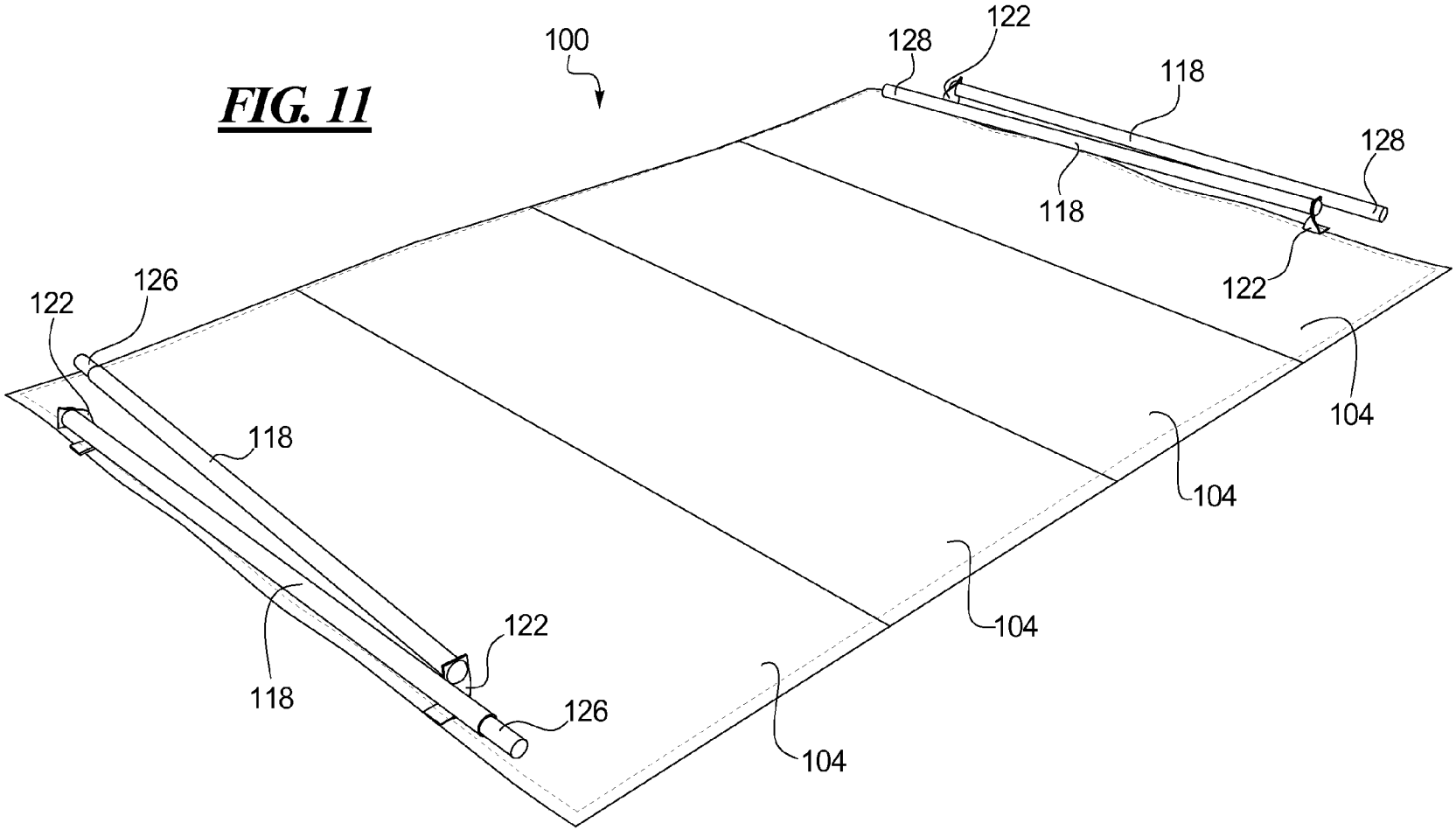
FIG. 11 shows the mattress of FIG. 10 but with the mattress supports moved to a stowed position.

When the mattress support structure 102 is in the in-use arrangement or assembled condition of FIG. 9, the mattress is retained in a flat state. When the mattress support structure 102 is disassembled as in FIG. 10, the stiffeners are no longer capable of retaining the mattress in a flat state. The tube segments 118 can however be moved to a stowed position as shown in FIG. 11. The fabric tabs 122 in this example should be long enough and flexible enough to permit free rotation of the tube segments from the lengthwise orientation of FIGS. 9 and 10 to the widthwise stowed orientation of FIG. 11. The tabs 122 need not be fabric but should have sufficient flexibility to allow such movement. In the stowed position, the tube segments 118 are oriented in a widthwise direction parallel with the end edges 114 in this example. In other examples, the tube segments may be parallel with the fold joints 106 but spaced inboard from the end edges 114.

Figure 12:
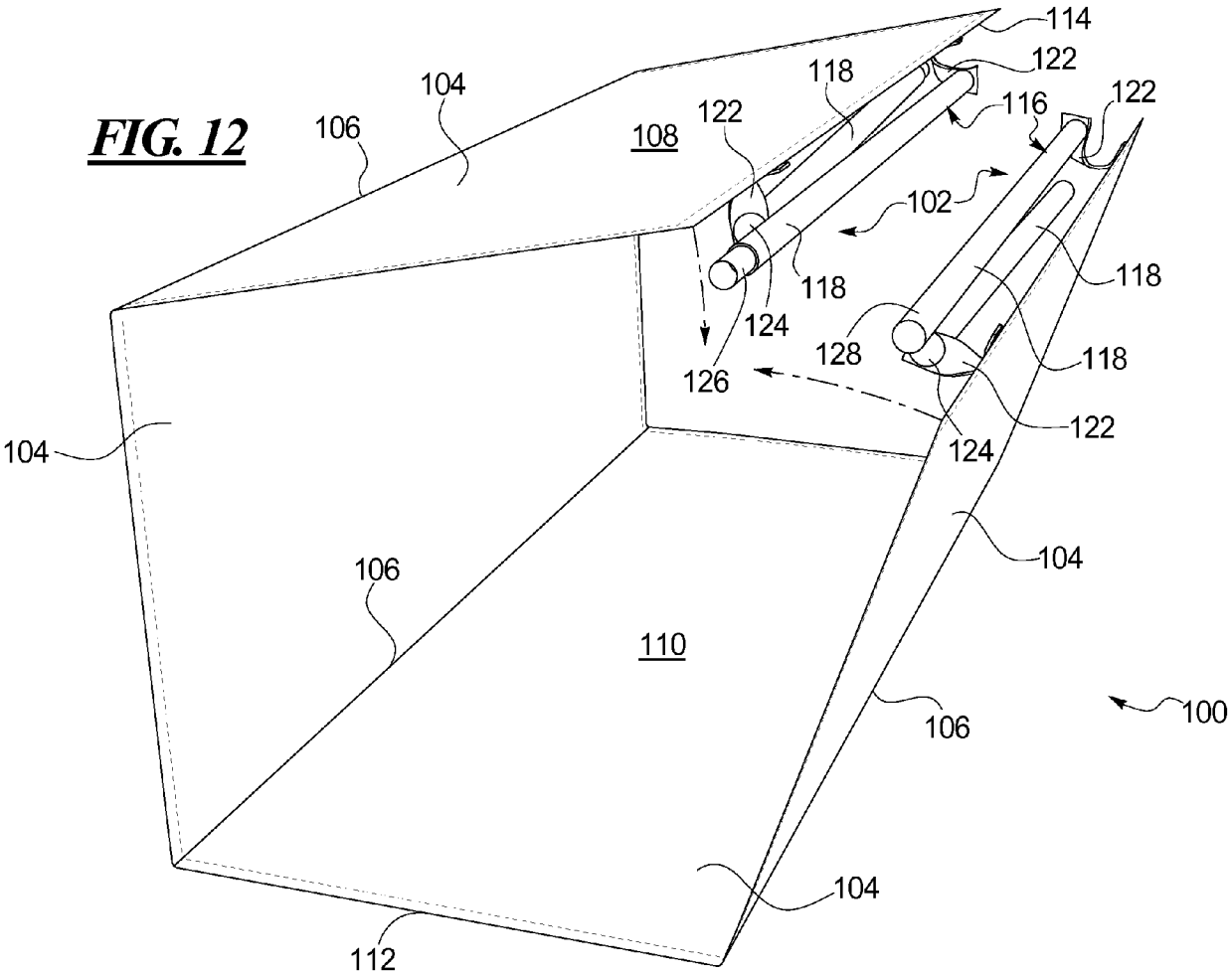
FIG. 12 shows the mattress of FIG. 11 but with the mattress folded up to a storage or a stowed configuration.

The mattress 100 can then be folded up to a rectangular configuration about the fold joints 106, as is known in the art and as depicted in FIG. 12. A typical playard 32 is folded up to a compact storage configuration, which is then wrapped by the mattress 100. The tube segments 118 in this example have a length when disengaged and stowed that fits entirely within the parameters or package size of the folded mattress 100. Thus, the stiffeners 116 will not protrude from the folded up playard structure and will take up only minimal space within the folded up product package. VELCRO or other types of straps can be used to hold the tube segments 118 of the stiffeners 116 in the stowed position, if desired.

Figure 13:
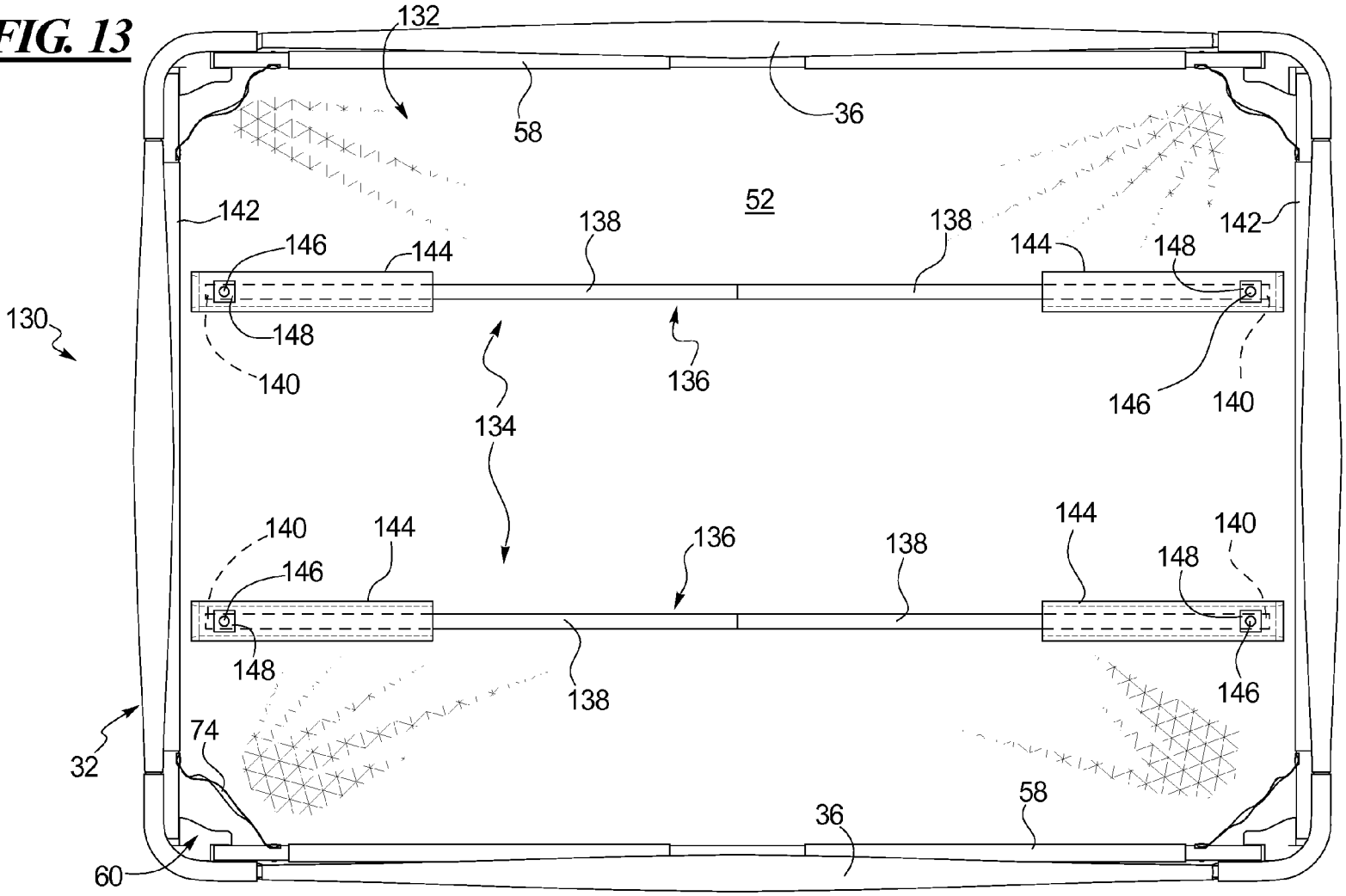
FIG. 13 shows a top view of another example of a playard and bassinet accessory combination with a mattress support structure constructed in accordance with the teachings of the present disclosure, the mattress support structure permanently attached to the bottom panel of the bassinet accessory and shown in an engaged arrangement.
Figure 14:
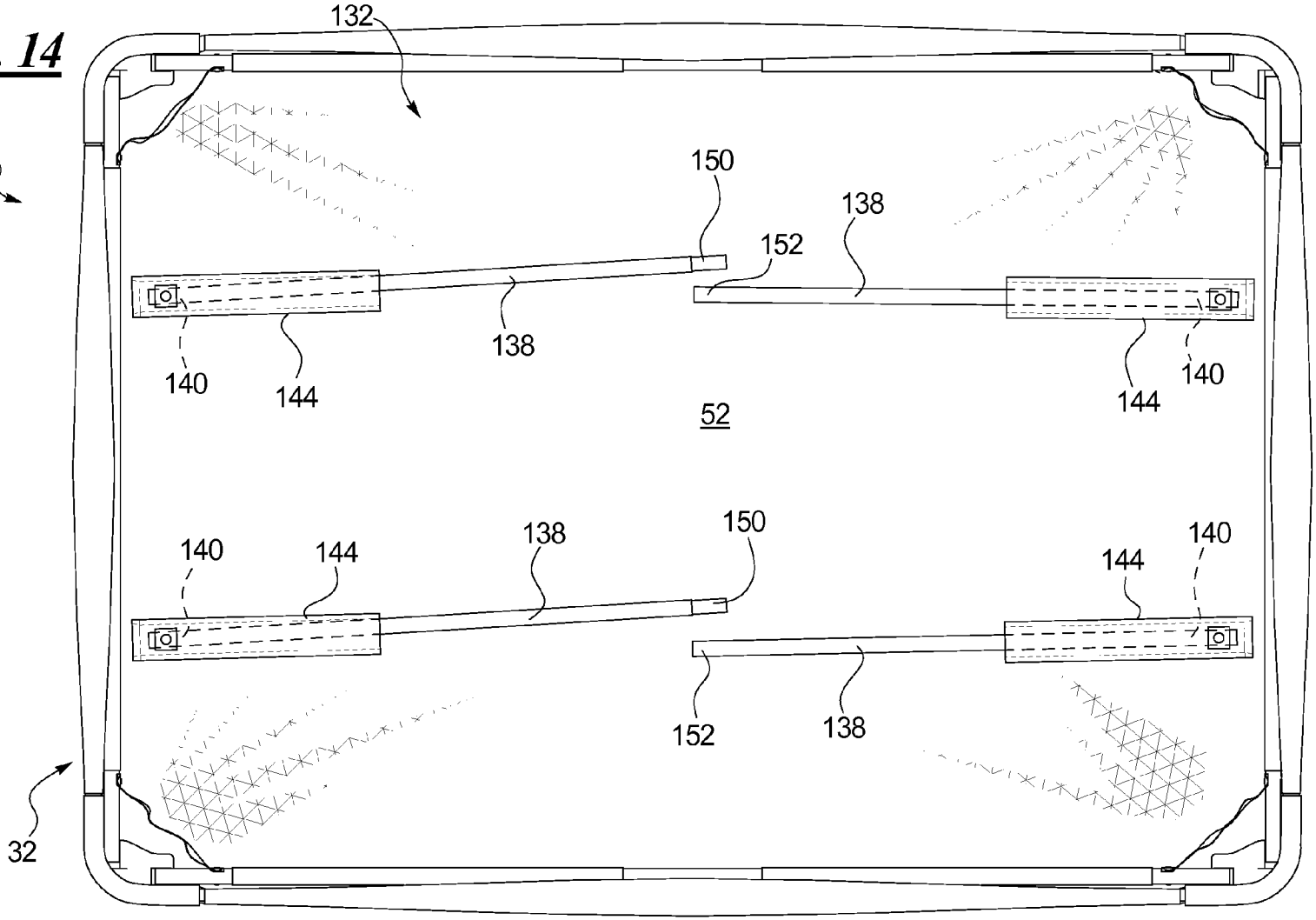
FIG. 14 shows the playard and bassinet accessory of FIG. 13 but with the mattress support structure in a disengaged arrangement.

FIGS. 13 and 14 show another example of a child containment device 130 constructed in accordance with the teachings of the present invention. In this example, the child containment device 130 has a playard 32, which can be substantially the same as the earlier described playard of FIG. 1 or different from the playard. The child containment device 130 also has a bassinet accessory 132, which is substantially similar to the bassinet accessory 50 of the earlier example in FIGS. 1-4. The bassinet accessory 132 has a fabric bed with a bottom panel 52, side panels 54, and fabric tunnels 58. The bassinet accessory 132 also has a bassinet support structure 60 that is the same as the earlier described example of FIGS. 1-4.

In this example, the bassinet accessory 132 includes a mattress support structure 134 irremovably attached to the bottom panel 52 of the fabric bed as shown in FIG. 13. The mattress support structure 134 has two spaced apart stiffeners 136 arranged lengthwise along the bottom panel 52 of the fabric bed. In this example, each stiffener 136 is a tube with two tube segments 138. A distal end 140 of each tube segment 138 is irremovably attached to the bottom panel 52 at or near an end edge 142 of the bottom panel. Four fabric tunnels 144 are sewn or otherwise attached to the bottom panel 52. Each fabric tunnel 144 is aligned with another in a lengthwise direction. The distal end 140 of each tube segment 138 is received in one of the fabric tunnels 144 and is irremovably fastened to the corresponding tunnel using a rivet 146 or other suitable fastener to irremovably attach the tube end 140 to the tunnel 144. A washer 148 can be used to support the head of the rivet 146 and to prevent or inhibit the rivet from tearing the fabric material of the tunnel 144. The type of fastener used can vary as long as the attachment or connection is irremovable or permanent within the context of this disclosure.

A shown in FIG. 14, one of the tube segments 138 of each stiffener 136 has a proximal end 150 that is swaged or tapered to a diameter that is smaller than the diameter of the proximal ends 152 of the other tube segments of the stiffeners. When the mattress support structure 134 is assembled as shown in FIG. 13, the smaller swaged ends 150 are received in the larger ends 152 to engage and connect the tube segments 138 of the stiffeners 136. When the mattress support structure 134 is disassembled, the tube segments 138 are separated at the proximal ends 150, 152 as shown in FIG. 14. The proximal ends 150, 152 can include a suitable locking mechanism, such as a VALCO ball arrangement, to releasably secure the tube segments 138 together.

When the mattress support structure 134 is in the assembled condition of FIG. 13, the mattress (not shown) is retained in a flat state. When the mattress support structure 134 is disassembled as in FIG. 14, the stiffeners 136 are no longer capable of retaining the mattress in a flat state. The tube segments 138 can however be moved to a stowed position parallel with one another to allow the bassinet accessory 132 to be broken down to a smaller size when detached from the playard 32. The fabric tunnels 144 in this example will however prevent the tube segments 138 from being twisted or rotated relative to the fabric of the bottom panel 52 of the fabric bed. The tunnels 144 need not be fabric, but making them from the same material reduces cost and complexity and makes manufacturing of the bassinet accessory 132 easier.

Figure 15:
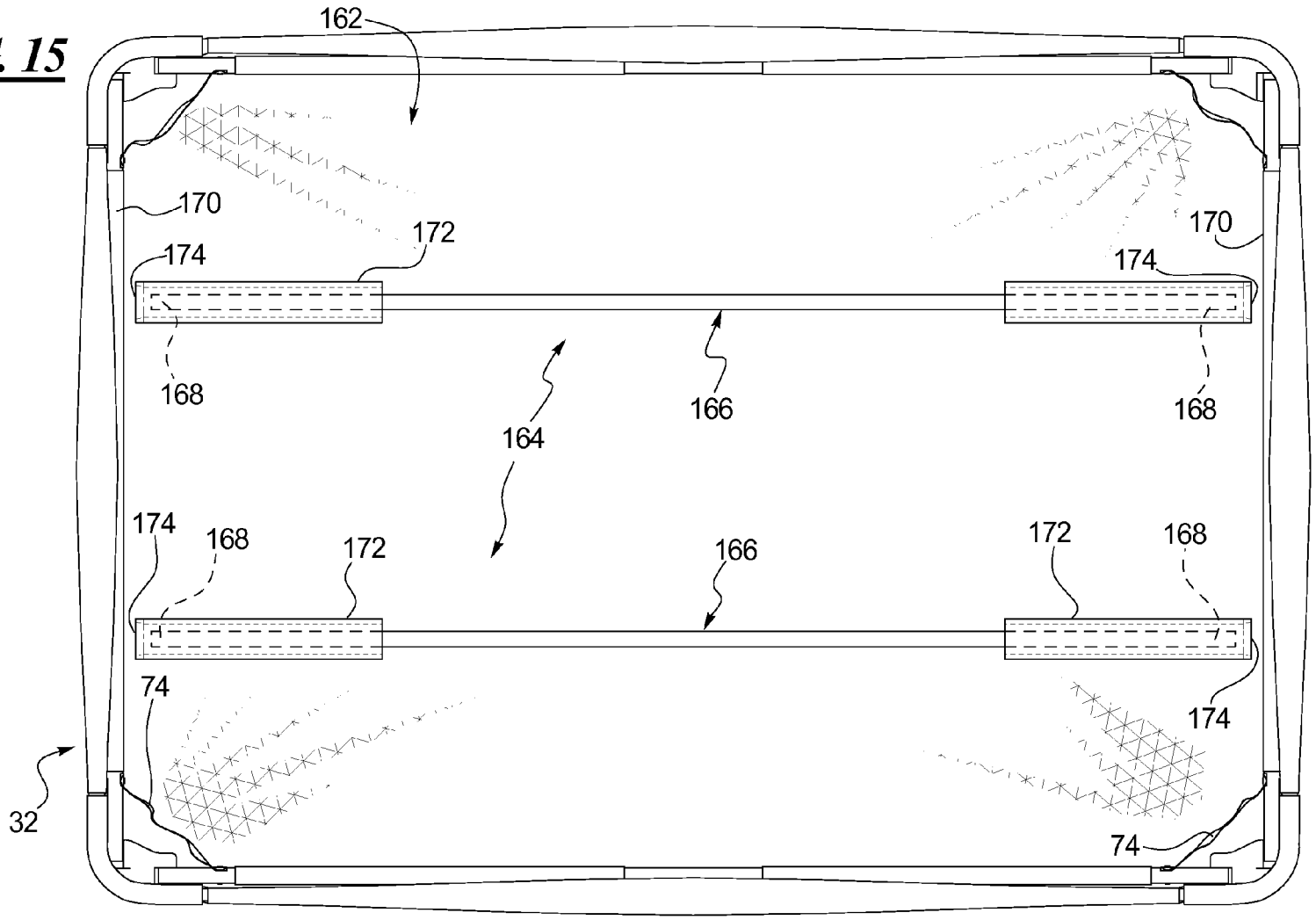
FIG. 15 shows a top view of another example of a playard and bassinet accessory combination with a mattress support structure constructed in accordance with the teachings of the present disclosure, the mattress support structure permanently attached to the bottom panel of the bassinet accessory and shown in an engaged arrangement.

FIG. 15 shows another example of a child containment device 160 constructed in accordance with the teachings of the present invention. In this example, the child containment device 160 is similar to the device 130 of FIGS. 13 and 14. The child containment device 160 also has a playard 32, which can be substantially the same as the earlier described playard of FIG. 1 or different from the playard. The child containment device 160 also has a bassinet accessory 162, which is substantially similar to the bassinet accessory 50 of the earlier example in FIGS. 1-4. The bassinet accessory 162 has a fabric bed with a bottom panel 52, side panels 54, and fabric tunnels 58. The bassinet accessory 162 also has a bassinet support structure 60 that is the same as the earlier described example of FIGS. 1-4.

In this example, the bassinet accessory 132 includes a mattress support structure 164 irremovably attached to the bottom panel 52 of the fabric bed as shown in FIG. 15. The mattress support structure 164 has two spaced apart stiffeners 166 arranged lengthwise along the bottom panel 52 of the fabric bed. In this example, each stiffener 166 is a single continuous tube. A distal end 168 of each stiffener 166 is irremovably attached to the bottom panel 52 at or near an end edge 170 of the bottom panel. Four fabric tunnels 172 are sewn or otherwise attached to the bottom panel 52. Each fabric tunnel 172 is aligned with another in a lengthwise direction. The distal end 168 of each stiffener 166 is captured in one of the fabric tunnels 172 during manufacture and attachment of the tunnels to the bottom panel 52. Each fabric tunnel 172 has a closed end 174 adjacent the distal end 168 of the stiffener 166. Since the stiffeners 166 are one-piece structures in this example, they do not break down. Since the stiffeners cannot exit the closed ends 174 of the fabric tunnels 172, the stiffeners are captured within and between the respective lengthwise aligned fabric tunnels. This renders the stiffeners 166 as being irremovably attached to the bassinet accessory 132.

The mattress support structure 164 remains in the assembled condition of FIG. 15 at all times. Thus, when the bassinet accessory 162, the mattress (not shown) is retained in a flat state. When the bassinet accessory 162 is removed from the playard 32, the stiffeners 166 can be collapsed closely parallel to one another, but the length of the folded up bassinet accessory will be limited by the length of the stiffeners 166.

The fabric tunnels 172 in this example will again prevent the stiffeners 166 from being twisted or rotated relative to the fabric of the bottom panel 52 of the fabric bed. The tunnels 172 need not be fabric, but making them from the same material reduces cost and complexity and makes manufacturing of the bassinet accessory 162 easier.

In the examples of FIGS. 13-15, the bassinet accessory is intended to be removed from the playard in order for the playard to be folded up. The bassinet accessories would then also have to be folded up and stowed separately. The following examples disclose child containment devices where the playard and bassinet accessory can be folded up together as a unit without having to remove or separate the two components.

FIGS. 16-19 show another example of a child containment device 180 constructed in accordance with the teachings of the present invention. The child containment device 180 has a playard 32 that can be identical to or different from the earlier described playard of FIG. 1. In this example, the child containment device 180 also has a bassinet accessory 182 with a fabric bed having a bottom panel 52 and side panels 54. A bassinet support structure 184 in this example has a plurality of inverted U-shaped clips 186 sewn to or otherwise attached to the top edges of the side panels 54. Plastic clips of this type are known in the art. The clips 186 are configured to clip onto and hang from the top rails 36 of the playard 32, suspending the bassinet accessory over the open interior of the playard. In this example, the bassinet support structure 184 is irremovably or permanently attached to the bassinet accessory 182 by the fact that the clips 186 are sewn or otherwise irremovably attached to the fabric bed material. There are no fabric tunnels in this example on the bassinet accessory for the bassinet support structure.

The bottom panel 52 of the fabric bed also has an access hole 188. A user can reach in through the access hole to access a pull on the floor panel of the playard 32. When folding up the playard 32 in this example, the bassinet accessory 182 can remain in place attached to the playard. The user can pull up on the floor panel to fold up the entire unit as is known in the art.

Figure 16:
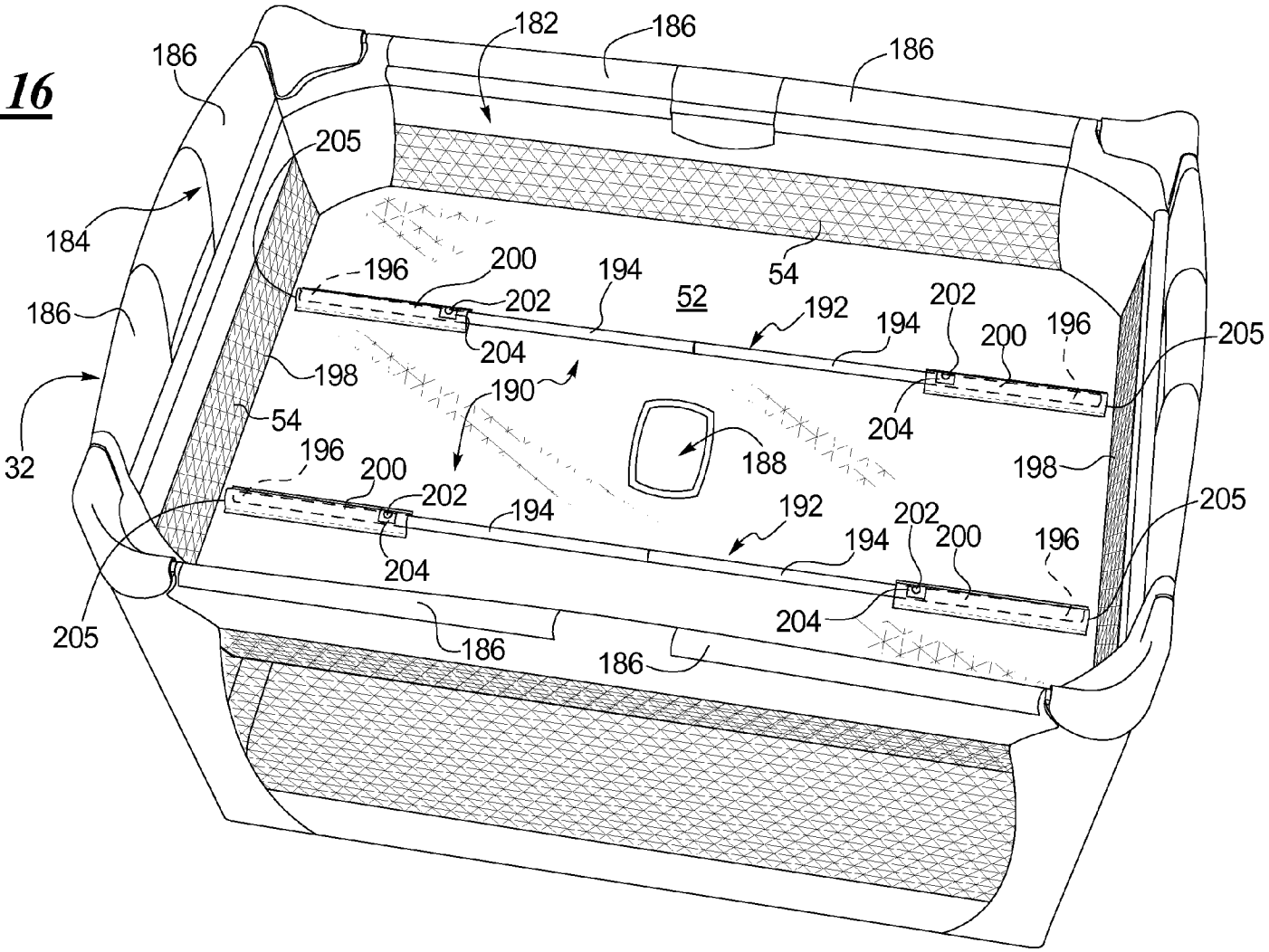
FIG. 16 shows a perspective view of another example of a playard and bassinet accessory combination where the bassinet accessory can fold up with the playard, the combination including a mattress support structure constructed in accordance with the teachings of the present disclosure and having mattress supports permanently attached to the bassinet bottom panel and shown in an engaged arrangement and an in-use position.

In this example, the bassinet accessory 182 includes a mattress support structure 190 irremovably attached to the bottom panel 52 of the fabric bed as shown in FIG. 16. The mattress support structure 190 has two spaced apart stiffeners 192 arranged lengthwise along the bottom panel 52 of the fabric bed. In this example, each stiffener 192 is a tube with two tube segments 194. A distal end 196 of each tube segment 194 is irremovably attached to the bottom panel 52 at or near an end edge 198 of the bottom panel. Four fabric tunnels 200 are sewn or otherwise attached to the bottom panel 52. Each fabric tunnel 200 is aligned with another in a lengthwise direction. The distal end 196 of each tube segment 194 is received in one of the fabric tunnels 200.

In this example, each tube segment 194 is irremovably fastened to the corresponding tunnel 200 using a rivet 202 or other suitable fastener. The rivet 202 is located spaced from the distal end 196 of each tube segment 194 and instead is closer to the proximal or inward end of each fabric tunnel 200 as shown in FIG. 16. A washer 204 can be used to support the head of the rivet 202 and to prevent or inhibit the rivet from tearing the fabric material of the tunnel 200. The type of fastener used can vary as long as the attachment or connection is irremovable or permanent within the context of this disclosure. In this example, each fabric tunnel 200 has a distal end 205 near the respective end edge 198 of the bottom panel 52. The distal end 205 of each fabric tunnel 200 is not closed, but open in this example for reasons discussed below.

Figure 17:
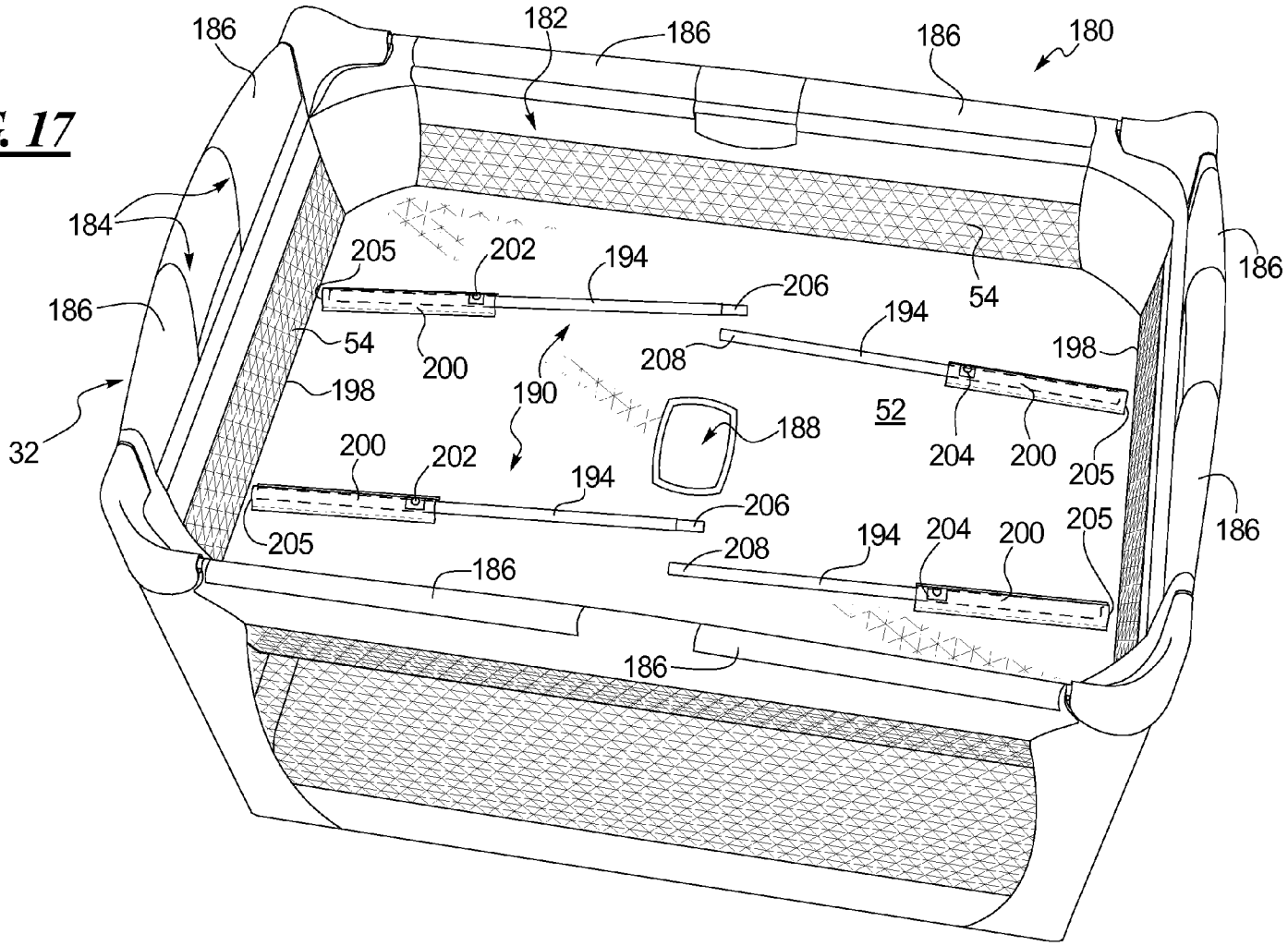
FIG. 17 shows the mattress support structure of FIG. 16 in a disengaged arrangement but in the in-use position.

A shown in FIG. 17, one of the tube segments 194 of each stiffener 192 has a proximal end 206 that is swaged or tapered to a diameter that is smaller than the diameter of the proximal ends 208 of the other tube segments of the stiffeners. When the mattress support structure 190 is assembled as shown in FIG. 16, the smaller swaged ends 206 are received in the larger ends 208 to engage and connect the tube segments 194 of the stiffeners 192. When the mattress support structure 190 is disassembled, the tube segments 194 are separated at the proximal ends 206, 208 as shown in FIG. 17. The proximal ends 206, 208 can include a suitable locking mechanism, such as a VALCO ball arrangement, to releasably secure the tube segments 194 together.

Figure 18:
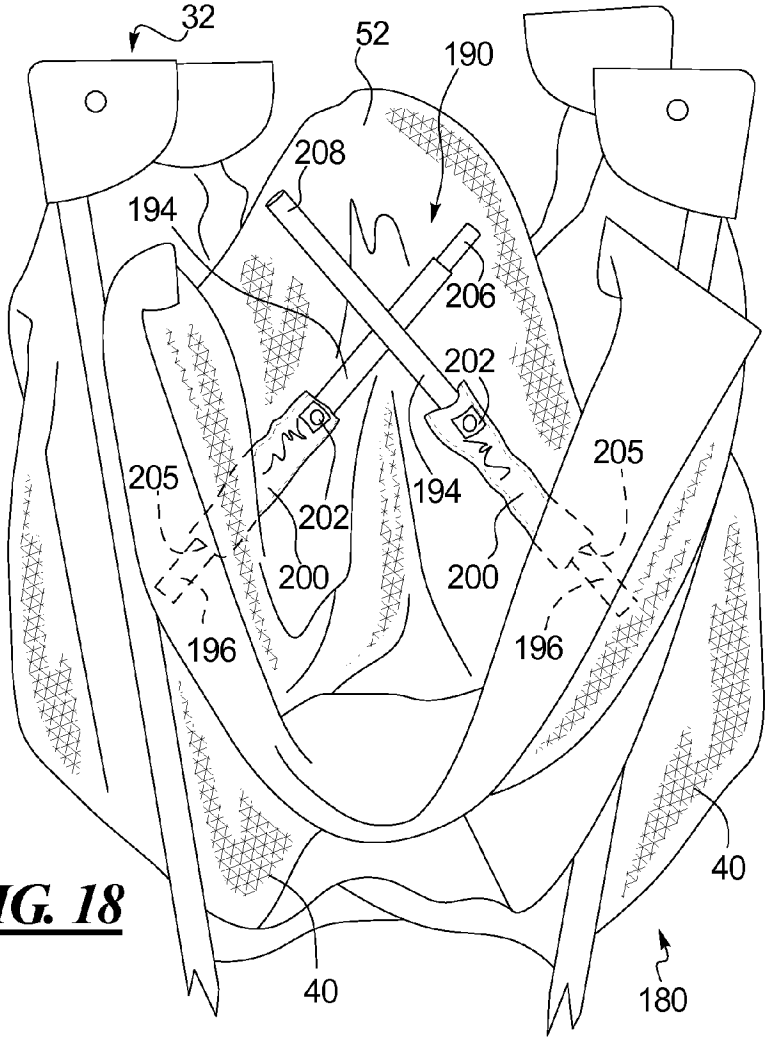
FIG. 18 shows a side view of the playard and bassinet accessory combination of FIG. 17, but with the combination in a partly folded up arrangement.

When the mattress support structure 190 is in the assembled condition of FIG. 16, the mattress (not shown) is retained in a flat state. When the mattress support structure 190 is disassembled as in FIG. 17, the stiffeners 192 are no longer capable of retaining the mattress in a flat state. The tube segments 194 can also move independently to allow for folding up of the playard. As noted above, the user can release a playard locking mechanism and reach through the access hole 188 to pull up on the floor panel and fold up the playard 32. In doing so, the floor panel is raised at the center. This in turn will raise the center of the fabric bed bottom panel 52, as shown in FIG. 18. When the bottom panel moves in this manner, the fabric tunnels 200 and tube segments 194 will reorient with the proximal ends 206, 208 extending upward and the fabric tunnel open ends 205 facing downward.

Figure 19:
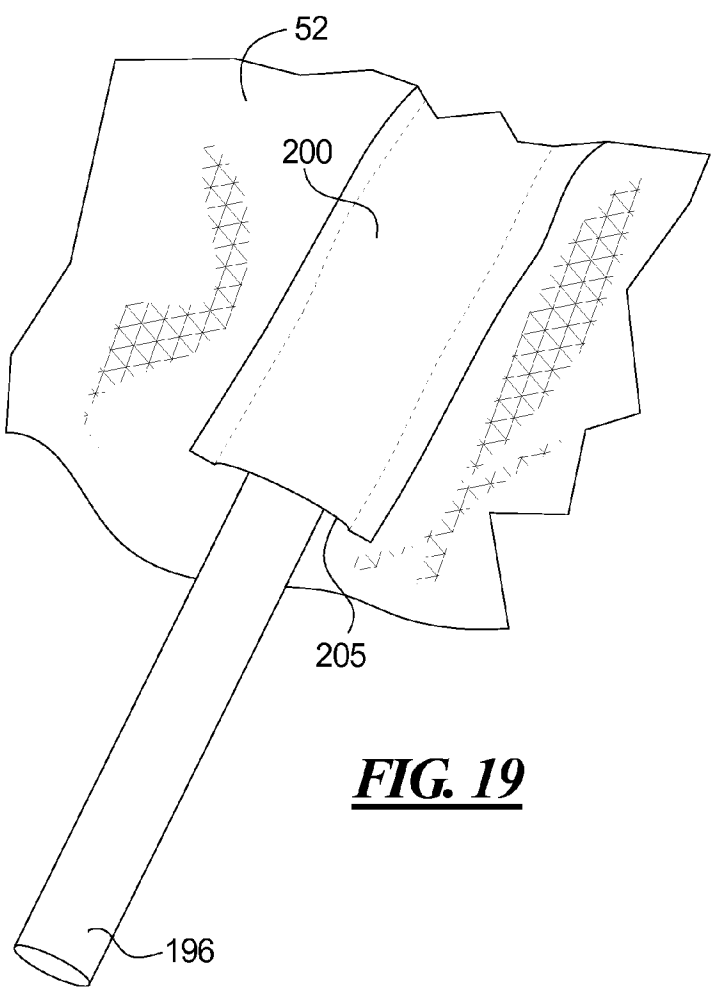
FIG. 19 shows a close up view of one part of the mattress support structure of the playard and bassinet accessory combination of FIG. 18.

During folding, the fabric tunnels 200 may bunch up in an upward direction. Because the rivets 202 fix the tube segments 194 to the tunnels 200, this may cause the tube segments to rise upward. However, the rivets 202 are positioned at the proximal ends of the tunnels, which allow the tunnel fabric to bunch up without immediately pushing the tube segments 194 upward. Also, in order to aid in preventing the proximal ends 206, 208 of the tube segments 194 from protruding upward beyond the parameters of the folded up playard 32, the open ends 205 of the fabric tunnels 200 permit the distal ends 196 to extend below the fabric tunnels through the open ends, as shown in FIG. 19. This permits the fabric tunnels to bunch up even further and rise without pushing the tube segments 194 up.

FIGS. 20-23 show another example of a child containment device 220 constructed in accordance with the teachings of the present invention. The child containment device 220 is similar to the device 180 in the previous example. The child containment device 220 again has a playard 32 that can be identical to or different from the earlier described playard of FIG. 1. In this example, the child containment device 220 also has a bassinet accessory 222 with a fabric bed having a bottom panel 52 and side panels 54. There again are no fabric tunnels in this example on the bassinet accessory for the bassinet support structure. The bassinet support structure 184 in this example uses the same plurality of clips 186 sewn to or otherwise attached to the top edges of the side panels 54. The bassinet support structure 184 is again irremovably or permanently attached to the bassinet accessory 222 by the fact that the clips 186 are sewn or otherwise irremovably attached to the fabric bed material.

The bottom panel 52 of the fabric bed also has an access hole 188 for the same purpose as described for the previous example. A user can reach in through the access hole to access a pull on the floor panel of the playard 32 to fold up the playard 32 while the bassinet accessory 222 remains in place attached to the playard.

Figure 20:
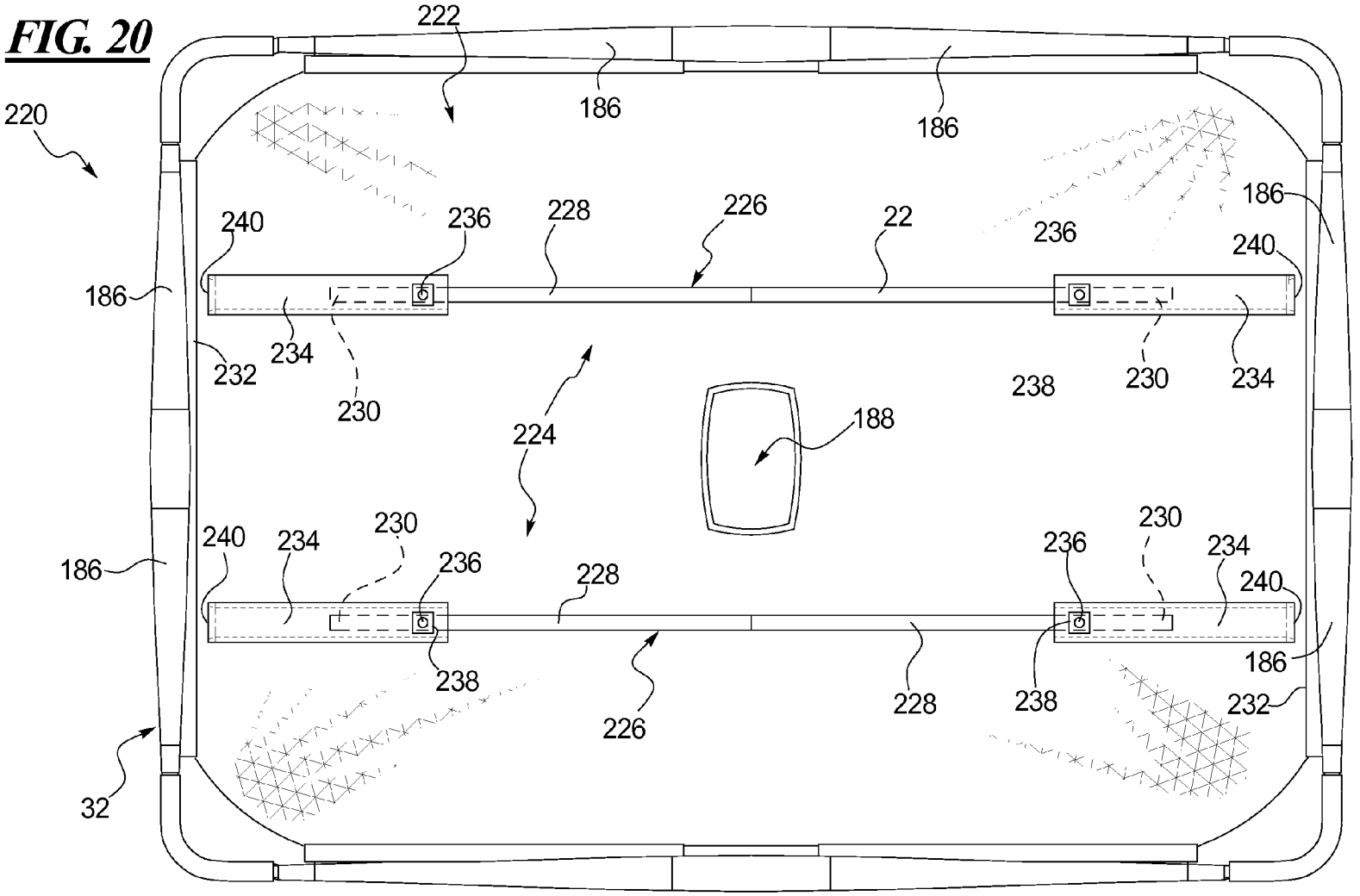
FIG. 20 shows a top view of another example of a playard and bassinet accessory combination where the bassinet accessory can fold up with the playard, the combination including a mattress support structure constructed in accordance with the teachings of the present disclosure and having mattress supports permanently attached to the bassinet bottom panel and shown in an engaged arrangement and an in-use position.

In this example, the bassinet accessory 222 includes a mattress support structure 224 irremovably attached to the bottom panel 52 of the fabric bed as shown in FIG. 20. The mattress support structure 224 has two spaced apart stiffeners 226 arranged lengthwise along the bottom panel 52 of the fabric bed. In this example, each stiffener 226 is a tube with two tube segments 228. A distal end 230 of each tube segment 228 is irremovably attached to the bottom panel 52 at or near an end edge 232 of the bottom panel. Four fabric tunnels 234 are sewn or otherwise attached to the bottom panel 52. Each fabric tunnel 234 is aligned with another in a lengthwise direction. The distal end 230 of each tube segment 228 is received in one of the fabric tunnels 234.

In this example, each tube segment 228 is irremovably fastened to the corresponding tunnel 234 using a rivet 236 or other suitable fastener. The rivet 236 is located spaced from the distal end 230 of each tube segment 228 and instead is closer to the proximal or inward end of each fabric tunnel 234 as shown in FIG. 20. A washer 238 can be used to support the head of the rivet 236 and to prevent or inhibit the rivet from tearing the fabric material of the tunnel 234. The type of fastener used can vary as long as the attachment or connection is irremovable or permanent within the context of this disclosure. In this example, each fabric tunnel 234 has a distal or closed end 240 near the respective end edge 232 of the bottom panel 52. The closed end 240 of each fabric tunnel 234 is closed or sewn up. As shown in FIG. 20, the distal ends 230 of the tube segments 228 are instead shorter in length than the fabric tunnels 234, terminating well short of the closed ends 240.

Figure 21:
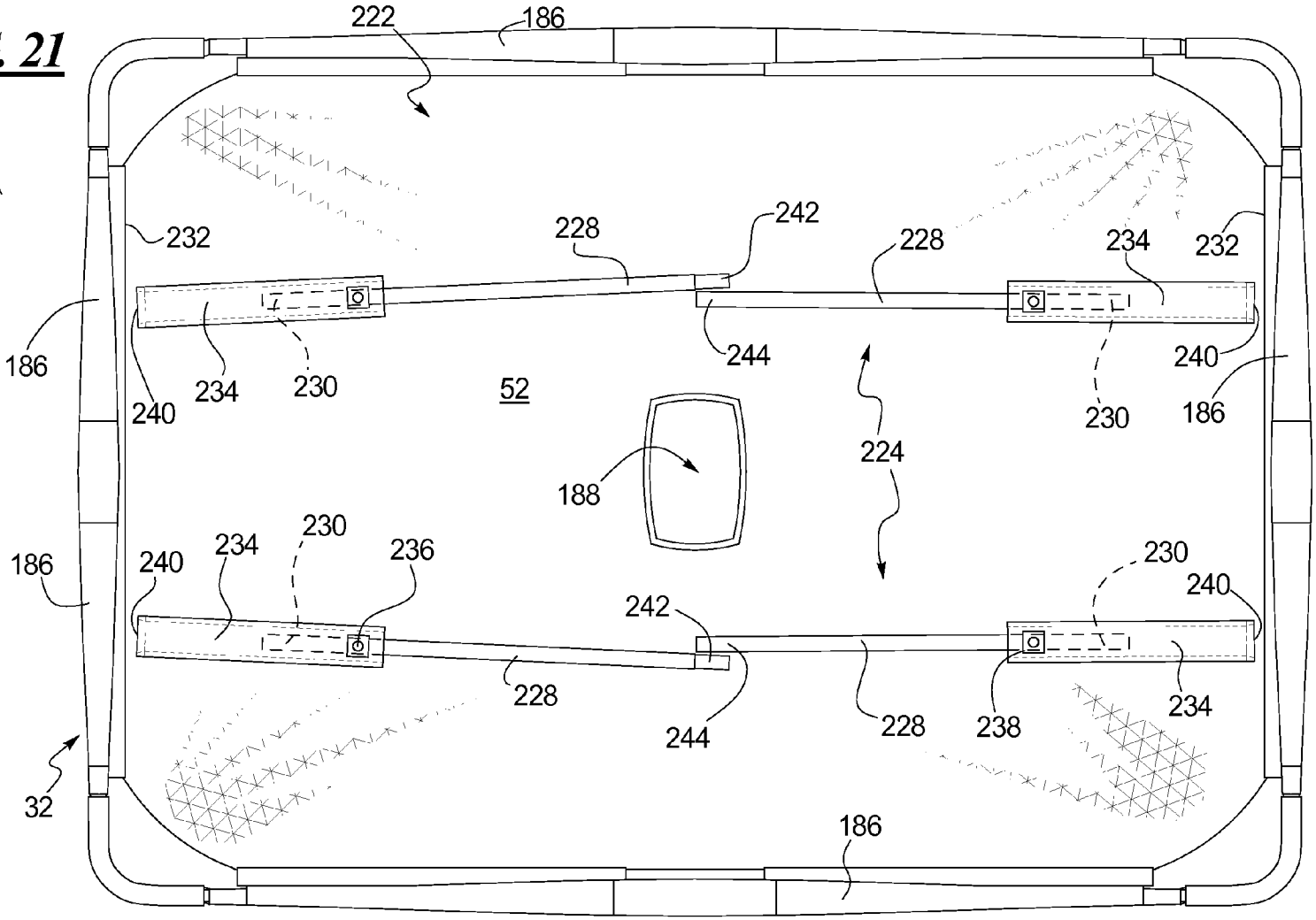
FIG. 21 shows the mattress support structure of FIG. 20 in a disengaged arrangement but in the in-use position.

A shown in FIG. 21, one of the tube segments 228 of each stiffener 226 has a proximal end 242 that is swaged or tapered to a diameter that is smaller than the diameter of the proximal ends 244 of the other tube segments of the stiffeners. When the mattress support structure 224 is assembled as shown in FIG. 20, the smaller swaged ends 242 are received in the larger ends 244 to engage and connect the tube segments 228 of the stiffeners 226. When the mattress support structure 224 is disassembled, the tube segments 228 are separated at the proximal ends 242, 244 as shown in FIG. 21. The proximal ends 242, 244 can include a suitable locking mechanism, such as a VALCO ball arrangement, to releasably secure the tube segments 228 together.

Figure 22:
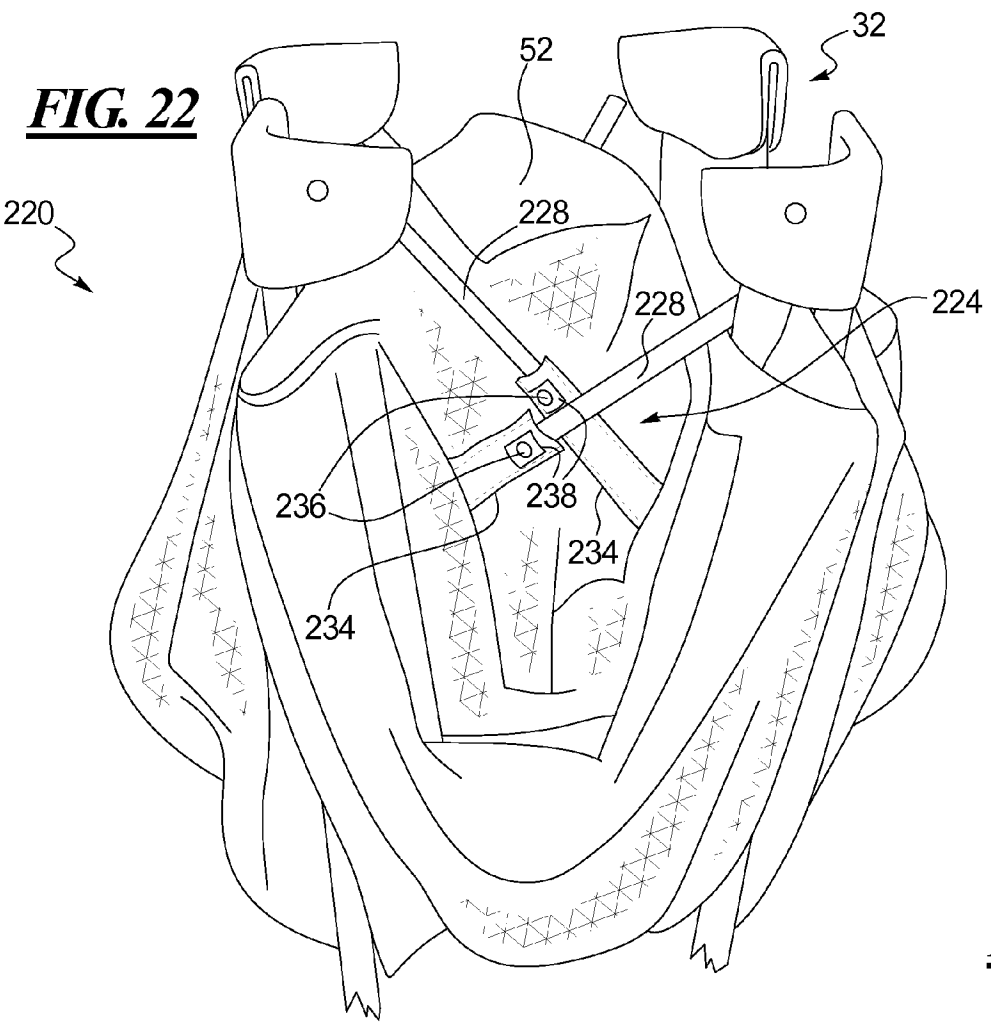
FIG. 22 shows a side view of the playard and bassinet accessory combination of FIG. 21, but with the combination in a partly folded up arrangement.

When the mattress support structure 224 is in the assembled condition of FIG. 20, the mattress (not shown) is retained in a flat state. When the mattress support structure 224 is disassembled as in FIG. 21, the stiffeners 226 are no longer capable of retaining the mattress in a flat state. The tube segments 228 can also move independently to allow for folding up of the playard. As noted above, the user can release a playard locking mechanism and reach through the access hole 188 to pull up on the floor panel and fold up the playard 32. In doing so, the floor panel is raised at the center. This in turn will raise the center of the fabric bed bottom panel 52, as shown in FIG. 22. When the bottom panel moves in this manner, the fabric tunnels 234 and tube segments 228 will reorient with the proximal ends 242, 244 extending upward and the fabric tunnel closed end 240 facing downward.

Figure 23:
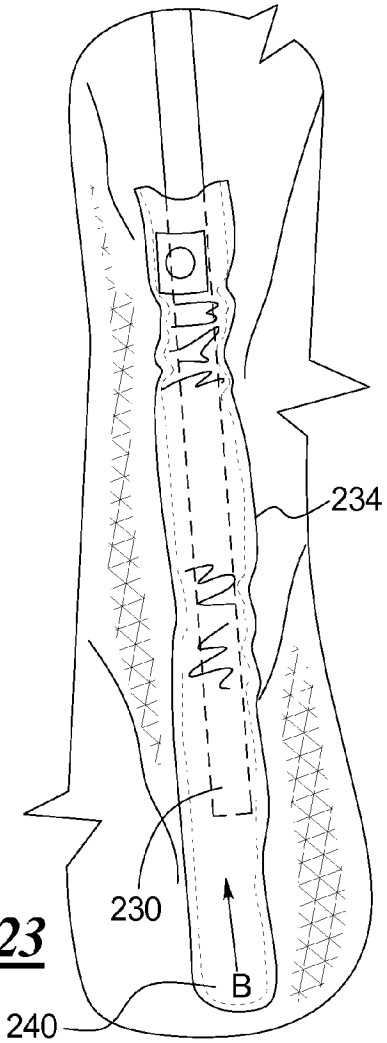
FIG. 23 shows a close up view of one part of the mattress support structure of the playard and bassinet accessory combination of FIG. 22.

During folding, the fabric tunnels 234 may bunch up in an upward direction. Because the rivets 236 fix the tube segments 228 to the tunnels 234, this may cause the tube segments to rise upward. However, the rivets 236 are positioned at the proximal ends of the tunnels 234, which allow the tunnel fabric to bunch up without immediately pushing the tube segments 228 upward. Also, in order to aid in preventing the proximal ends 242, 244 of the tube segments 228 from protruding upward beyond the parameters of the folded up playard 32, the gap between the closed ends 240 of the fabric tunnels 236 and the shorter distal ends 230 permits the fabric tunnels to bunch up even further (see arrow B) before contacting the ends of the tube segments 228 as shown in FIG. 23. This permits the fabric tunnels to bunch up even further and rise without pushing the tube segments 228 up.

Figure 24:
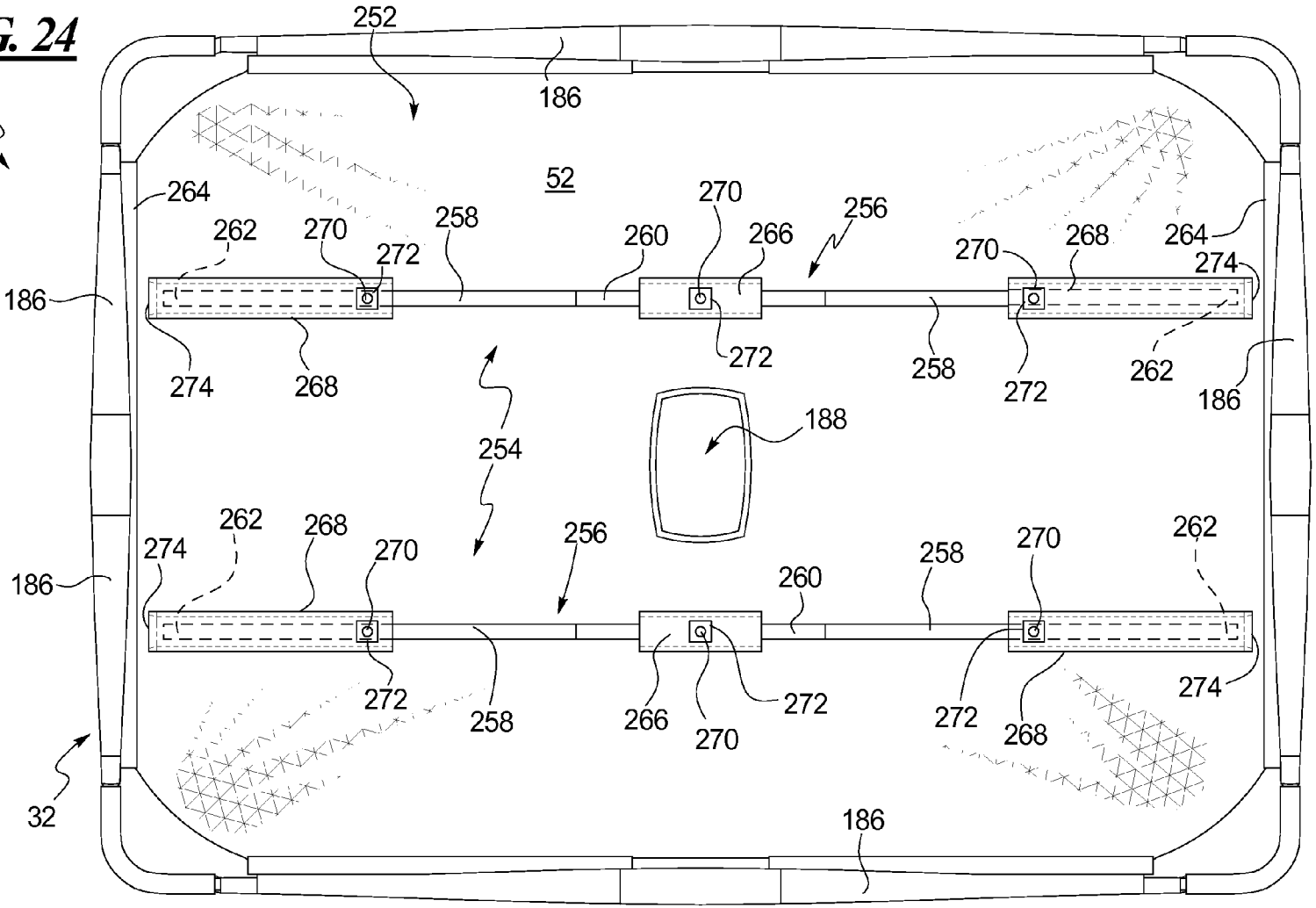
FIG. 24 shows a top view of another example of a playard and bassinet accessory combination where the bassinet accessory can fold up with the playard, the combination including a mattress support structure constructed in accordance with the teachings of the present disclosure and having mattress supports permanently attached to the bassinet bottom panel and shown in an engaged arrangement and an in-use position.
Figure 25:
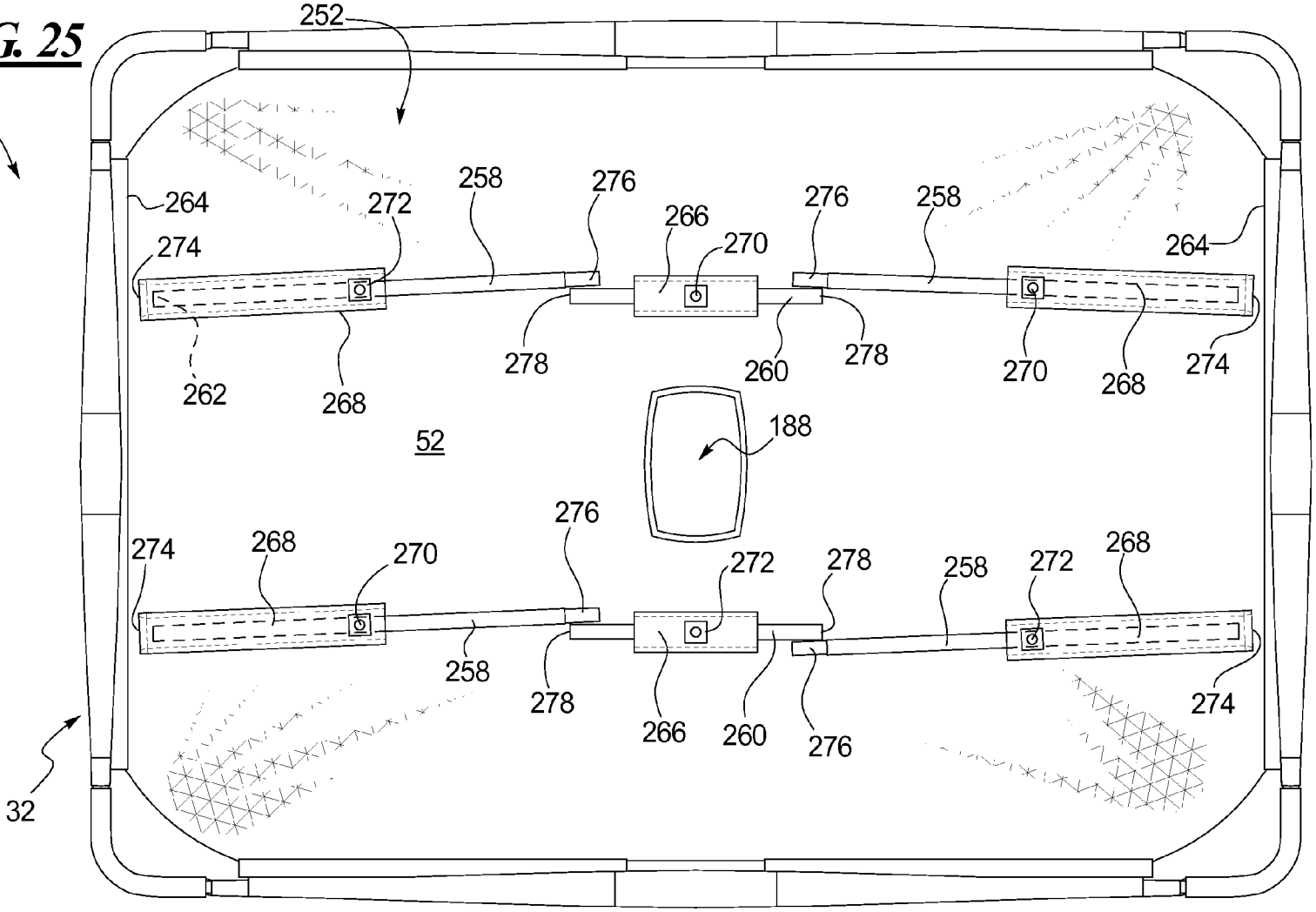
FIG. 25 shows the mattress support structure of FIG. 24 in a disengaged arrangement but in the in-use position.
Figure 26:
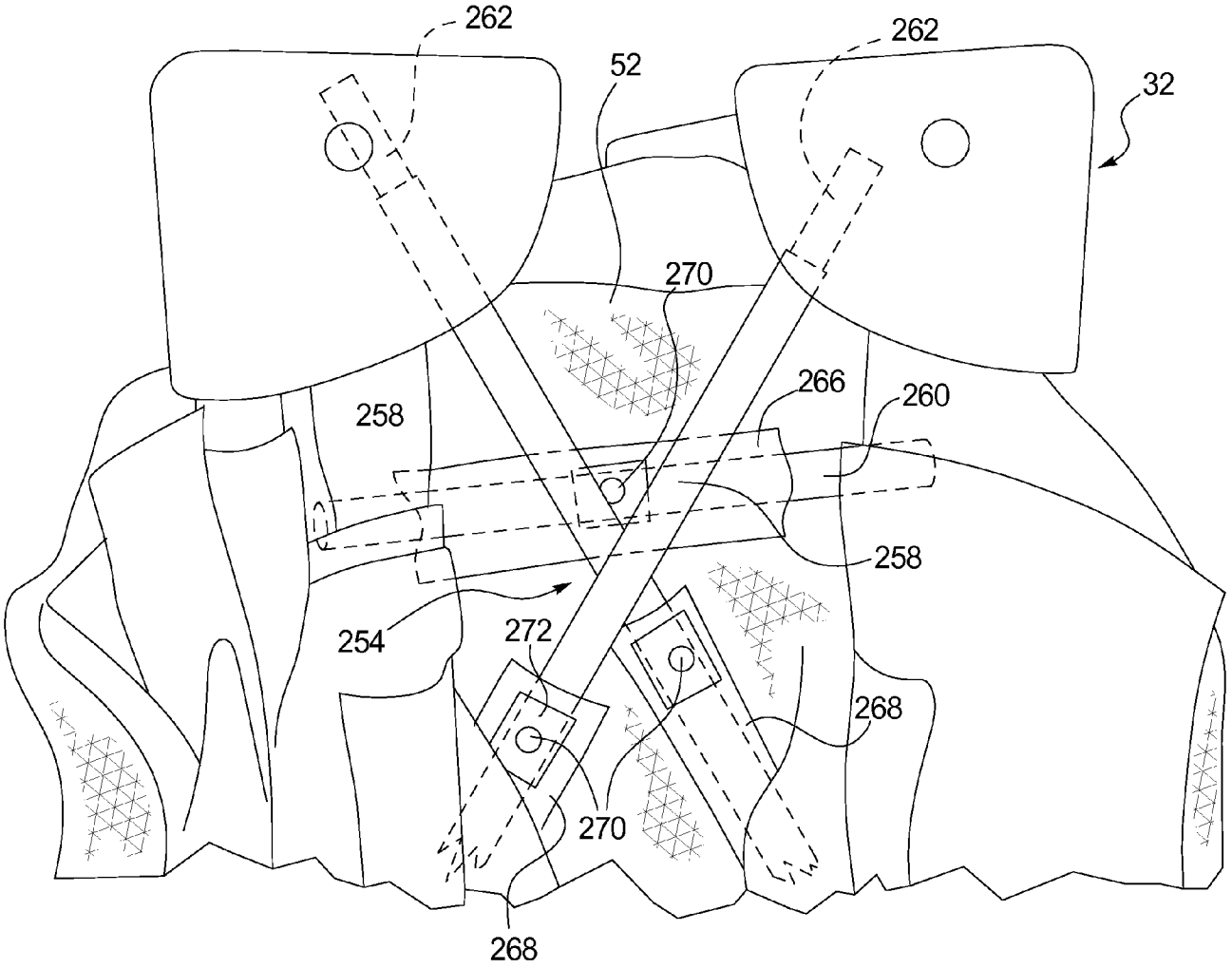
FIG. 26 shows a close up side view of a portion of the playard and bassinet accessory combination of FIG. 25 and in a partly folded up arrangement.

FIGS. 24-26 show another example of a child containment device 250 constructed in accordance with the teachings of the present invention. The child containment device 250 is similar to the devices 180 and 220 of the previous examples. The child containment device 250 also has a playard 32 that can be identical to or different from the earlier described playard of FIG. 1. In this example, the child containment device 250 also has a bassinet accessory 252 with a fabric bed having a bottom panel 52 and side panels 54. There again are no fabric tunnels in this example on the bassinet accessory for the bassinet support structure. The same bassinet support structure 184 is used in this example and has the plurality of inverted U-shaped clips 186 sewn to or otherwise attached to the top edges of the side panels 54. In this example, the bassinet support structure 184 is again irremovably or permanently attached to the bassinet accessory 252 by the fact that the clips 186 are sewn or otherwise irremovably attached to the fabric bed material.

The bottom panel 52 of the fabric bed also has an access hole 188 for the same purpose as previously described. A user can reach in through the access hole to access a pull on the floor panel of the playard 32 when folding up the playard 32. The bassinet accessory 252 can again remain in place attached to the playard when the playard is folded up.

In this example, the bassinet accessory 252 includes a mattress support structure 254 irremovably attached to the bottom panel 52 of the fabric bed as shown in FIG. 24. The mattress support structure 254 has two spaced apart stiffeners 256 arranged lengthwise along the bottom panel 52 of the fabric bed. In this example, each stiffener 256 is a tube with three tube segments including two end segments 258 and a shorter central segment 260. A distal end 262 of each end segment 258 is irremovably attached to the bottom panel 52 at or near an end edge 264 of the bottom panel. Two sets of three fabric tunnels are sewn or otherwise attached to the bottom panel 52. Each fabric tunnel set is aligned with the other two tunnels of the set in a lengthwise direction as shown in FIG. 24. Each set of fabric tunnels includes a central tunnel 266 and two remote tunnels 268.

The distal end 262 of each tube end segment 258 is received in one of the remote fabric tunnels 268. The central tube segment 260 is received through and protrudes from both ends of the central tunnel 266. In this example, each tube segment 258, 260 is irremovably fastened to the corresponding tunnel 266, 268 using a rivet 270 or other suitable fastener. The rivet 270 is located at the center of the central tunnel 268 and central tube segment 260 in this example. The rivet 270 is spaced from the distal end 262 of each end segment 258 and instead is closer to the proximal or inward end of each remote fabric tunnel 268 as shown in FIG. 24. A washer 272 can be used to support the head of each rivet 270 and to prevent or inhibit the rivet from tearing the fabric material of the tunnels 266, 268. The type of fastener used can vary as long as the attachment or connection is irremovable or permanent within the context of this disclosure. In this example, each remote fabric tunnel 268 has a distal closed end 274 near the respective end edge 264 of the bottom panel 52. The closed end 274 of each remote fabric tunnel 268 can be closed in this example for reasons discussed below.

A shown in FIG. 25, the tube end segment 258 of each stiffener 256 has a proximal end 276 that is swaged or tapered to a diameter that is smaller than the diameter of the corresponding end 278 of the central tube segment 260 of the stiffeners. When the mattress support structure 254 is assembled as shown in FIG. 24, the smaller swaged ends 276 are received in the larger ends 278 to engage and connect the tube segments 258, 260 of the stiffeners 256. When the mattress support structure 254 is disassembled, the tube end segments 258 are each separated from the respective central segments 260 at the corresponding proximal ends 276, 278 as shown in FIG. 25. The proximal ends 276, 278 can include suitable locking mechanisms, such as a VALCO ball arrangement, to releasably secure the tube segments 258, 260 together.

When the mattress support structure 254 is in the assembled condition of FIG. 24, the mattress (not shown) is retained in a flat state. When the mattress support structure 254 is disassembled as in FIG. 25, the stiffeners 256 are no longer capable of retaining the mattress in a flat state. The tube segments 258, 260 can also move independently to allow for folding up of the playard. As noted above, the user can release a playard locking mechanism and reach through the access hole 188 to pull up on the floor panel and fold up the playard 32. In doing so, the floor panel is raised at the center. This in turn will raise the center of the fabric bed bottom panel 52, as shown in FIG. 26. When the bottom panel moves in this manner, the central tunnels 266 and central tube segments 260 will stay level or generally horizontal. However, the end tube segments 258 and the remote tunnels 268 will reorient with the proximal ends 276 extending upward and the fabric tunnel closed ends 274 facing downward.

During folding, the remote fabric tunnels 268 cannot bunch up. This is in part because the distal ends 262 of the end segments 258 are closely adjacent the closed ends 274 of the remote tunnels 268 and in part because the rivets 270 fix the tube end segments to the tunnels. Thus, as soon as the remote tunnels rise up with the bottom panel 52, the tube segments 258 will also rise upward. However, the tube end segments 258 are shorter in this example than in the previous two examples. This is because the stiffeners 256 also include the central segment 260, which is detached from both end segments. Thus, even though the end tube segments 258 might rise upward, the proximal ends 276 will end up lower because of the shorter length of the segments. This again aids in preventing the proximal ends 276 of the tube end segments 258 from protruding upward beyond the parameters of the folded up playard 32. The shorter central tube segments 260 are narrower than a width of the folded up playard package size and are also horizontally oriented as shown in FIG. 26. Thus, the central segments will also not interfere with folding up the playard and will lie within the parameters of the folded up playard.

The disclosed child containment structures address the MKSE requirements in different ways. The examples shown and described herein can vary. The disclosed webbing and tunnel to stiffener attachment points can be connected by screws or other suitable means. The webbing of the first example can instead be a cord or other flexible material such as an elastic cord or strap or a wire. The fabric beds are disclosed herein with openings or gaps at the corners brackets. The opening or gap allows a user or caregiver to have visual confirmation that the bassinet support structures are properly in place and assembled. The fabric tunnels on some embodiments may extend further than shown to cover portions of the bassinet support structure. For example, see the phantom fabric tunnel continuations depicted in FIG. 3. Other numbers and arrangements of stiffeners, stiffener segments, tubes, or tube segments can be used in many of the disclosed examples. Also, suitable alternatives to the disclosed tubes can be used, as noted above, and can be made from steel, aluminum, other metals, plastic materials, or the like.

Other suitable connection devices and methods can be used in many of the examples to irremovably attach the disclosed stiffeners to the child containment device components. For example, stitching, press-on fittings, grommets, fasteners, flexible fingers, or arrowhead style connectors can be used. Webbing, cords, plastic stitched connectors, and the like can be used and these materials can be attached, connected, or fastened to the stiffeners in different ways. The connection points between the support structures and the child containment device components can also be varied from the examples disclosed and described herein.

The stiffeners of the mattress support structures can be configured to be attached near a mid-point and then pivot about the mid-point between the in-use position and the stowed position where possible. The stiffener segments can be connected to one another by webbing, elastic straps, cord, or the like in many of the disclosed examples. Such a construction may aid a user in determining the proper arrangement and assembly when setting up the child containment device. The rivets (or other fastener connections) disclosed herein can both irremovably attach components and define a swivel point for repositioning the components. Only one stiffener may be utilized on many of the examples, though most are described herein using two or more stiffeners.

The fabric tunnels can include mesh material to allow a user to visually confirm proper connection of stiffener segments. Instead of detachable connections among stiffener segments, hinge connections can be used where possible. These hinge connections can vary but in one example can include a webbing or strap connection among adjacent stiffener segments. The hinge connections can include auto locking flat tabs to improve stiffness and strength and prevent folding or collapse in a particular desired direction, such as downward. Locking can require manual unlocking to fold up the structures. A clasp, lock, or snap button that can seat in place to lock the structural element or support tube can be used.

Use of the button hole concept of FIGS. 16-19 retains the child containment devices' capability to fold up as one unit without affecting the overall folded up or packaged size of the assembly when folded. The button holes and tube segment fasteners can be located or positioned along the length of the tube segments to allow the tube segments to slide through the bassinet end walls during fold to prevent the tube sections from protruding up and out of the folded product. The length of the fabric tunnels can be selected so as to help manage and direct the mattress support tubes during folding. Part cost would be relatively reasonable and have little to no effect on the cost of existing playard assembly designs. In addition, no new tooling would be required and only minimal part cost (button hole plastic rings and tube to fabric tunnel fasteners) would be required.

The orientation of the button holes can be varied, depending on which panel, i.e., bottom or end wall, that they are formed on, and can be either parallel or perpendicular to the tube sections. This could affect mattress flatness or performance during folding and/or unfolding. The location of the fixed point between the fabric tunnels and tube sections can be modified to achieve a desired or appropriate amount of slide through the fabric tunnels. The tube segment length can also be adjusted to achieve an optimum amount of tube segment that protrudes from the button holes. This may be important to avoid damage to the bassinet fabric mesh walls during use. The free or distal ends of the tube segments can have a rounded end or end cap to help prevent any such damage during contact between the bassinet wall mesh material and the tube section ends.

In the example of FIGS. 20-23, the tube to tunnel fasteners can be located and the tube segment length can be designed to allow the tube segments to slide inside the tunnels and prevent the tubes from protruding up and out of the folded product. The fabric tunnel length can also be altered to manage and direct the mattress support tubes during folding. Fabric tunnel sleeves or extensions that extend beyond the end walls of the bassinet can also be used allowing the tube to protrude beyond the end walls during folding. Such extensions can be provided while still having a sewn closed end and allowing the tube sections to still be housed within a portion of a fabric tunnel.

The package size of the folded up assembly may not be altered or affected at all using the shorter tube sections of this example. Part cost would be relatively reasonable, requiring only the fasteners to secure or fix the fabric tunnels to the tube segments. No new tooling would be required to fabricate the components in this example. The mattress support structure would be shorter at the distal ends of the tube segments in the set up or in-use arrangement. The length of the tube segments, length of the fabric tunnels, and tunnel to tube fastener location can be selected to achieve a desired fold up function and folded up package size.

In the example of FIGS. 24-26, packaging of the unit can be manageable so as to not affect carton size. Part cost should be relatively reasonable, although an additional short tube, extra fastener, and minimal additional tunnel material may be required. No additional or new tooling would be required to fabricate the bassinet accessory of this example, other than a process to cut and form the short center tube section. In one alternate execution, one can remove the short fabric tunnel at the center. Instead, the short tube at the center can be attached pivotally to one or both of the end tube using webbing and pop-rivets. This could improve tube management during folding. The short center tube length can be altered, the fabric tunnel length can be altered, the end tube length can be altered, and the tube to tunnel fastener locations can be altered to improve assembly and fold.

Those having ordinary skill in the art will realize upon reading this disclosure that parts or all of the various examples may be interchanged with features of one or more of the other embodiments. Also, though some are described as being on a mattress bottom and some are described as being on a bassinet bottom panel, many if not all of the embodiments, or features and parts thereof, may be used or modified for use on the other of a mattress bottom or bassinet accessory bottom panel.

Although certain playards, child containment devices, bassinet accessories, bassinet support structures, and mattress support structures have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. A child containment device comprising:

a playard;

a bassinet accessory connected to the playard, the bassinet accessory comprising:

a bottom panel comprising:

two side perimeter edges and two end perimeter edges; and a at least two elongate stiffeners irremovably and permanently attached to the bottom panel of the bassinet accessory and spaced inward from the two side perimeter edges of the bottom panel;

a mattress having a top side defining a sleeping surface and removably positioned over the bottom panel and the at least two elongate stiffeners of the bassinet accessory;

wherein the playard and the bassinet accessory are configured to be adjusted together from an assembled, in-use configuration to a disassembled, folded up, storage configuration at the same time with the bassinet accessory, comprising the bottom panel and at least two elongate stiffeners, still coupled to the playard, and wherein, when the playard and the bassinet accessory is in the disassembled, folded up, storage configuration with the bassinet accessory still coupled to the playard, the mattress wraps around the playard and the bassinet accessory and defines an outer surface of a folded up child containment device and wherein the at least two elongate stiffeners fold up and fit entirely inside of the mattress defining the outer surface and within dimensions of the folded up child containment device.

2. A child containment device according to claim 1, wherein each elongate stiffener comprises two or more segments configured to be removably coupled and decoupled from one another.

3. A child containment device according to claim 2, wherein each of the two or more segments of the two elongate stiffeners is irremovably attached to the bottom panel.

4. A child containment device according to claim 1, wherein each of the at least two elongate stiffeners has a portion received in a fabric tunnel that is affixed to the bottom panel, the portion being irremovably coupled to the fabric tunnel.

5. A child containment device according to claim 4, wherein each fabric tunnel has a distal open end and wherein a free end of the portion of each of the at least two elongate stiffeners can slide through the distal open end when the bassinet accessory is in the disassembled, folded up, storage configuration.

6. A child containment device according to claim 4, wherein each fabric tunnel has a distal closed end and wherein a free end of the portion of each of the at least two elongate stiffeners 1) is spaced a first distance from the distal closed end of the corresponding fabric tunnel when the bassinet accessory is in the in-use configuration, and 2) is spaced a second distance closer than the first distance to the distal closed end when the bassinet accessory is in the disassembled, folded up, storage configuration.

7. A child containment device according to claim 1, wherein each of the at least two elongate stiffeners has two end segments irremovably coupled to the bottom panel and a central segment irremovably coupled to the bottom panel, and wherein the two end segments of each of the at least two elongate stiffeners are removably coupled to opposite ends of the respective central segment in an in-use arrangement and are decoupled from the opposite ends of the respective central segment when the bassinet accessory is in the disassembled, folded up, storage configuration.

8. A child containment device according to claim 7, wherein each of the end segments has a portion received in a fabric tunnel connected to the bottom panel.

9. A child containment device according to claim 1, wherein the bottom panel of the bassinet accessory further comprises an access hole disposed between the at least two elongated stiffeners and providing a passageway through the bottom panel.

10. A child containment device comprising:

a playard;

a bassinet accessory supported on the playard and comprising:

at least two side walls;

at least two end walls; and a bottom panel irremovably coupled to the side walls and end walls and comprising:

a first elongate stiffener irremovably attached to the bottom panel of the bassinet accessory and disposed laterally inward from the two side walls; and a second elongate stiffener irremovably attached to the bottom panel of the bassinet accessory and disposed laterally inward from the two side walls, wherein the first and second elongate stiffeners are arranged spaced apart from one another along a top surface of the bottom panel;

a mattress removably positioned above the bottom panel within the bassinet accessory the mattress having a length and a width that is less than the length and comprising a top side, an opposing underside, and a perimeter comprising two elongated side edges disposed along the length of the mattress and two end edges disposed along the width of the mattress;

wherein the playard and bassinet accessory are configured to be adjusted together from an assembled, in-use configuration to a disassembled, folded up, storage configuration at the same time with the bassinet accessory still coupled to the playard and the first and second elongate stiffeners irremovably coupled to the bottom panel of the bassinet.

11. A child containment device according to claim 10, wherein the bassinet accessory further comprises a first fabric tunnel and a second fabric tunnel disposed along and affixed to the top surface of the bottom panel and wherein the first elongate stiffener has a portion received in and irremovably coupled to the first fabric tunnel and the second elongate stiffener has a second portion received in and irremovably coupled to the second fabric tunnel.

12. A child containment device according to claim 11, wherein each of the first and second elongate stiffeners has opposed free ends received in and fastened to a different corresponding fabric tunnel affixed to the bottom panel of the bassinet accessory.

13. A child containment device according to claim 10, wherein each of the first and second elongate stiffeners has two stiffener segments that are removably coupled to one another and extend lengthwise along the mattress in an in-use arrangement and that can be decoupled from one another.

14. A child containment device according to claim 10, wherein the bottom panel of the bassinet accessory further comprises an access hole disposed between the first elongated stiffener and the second elongated stiffener and providing a passageway through the bottom panel.

15. A child containment device comprising:

a playard;

a bassinet accessory connected to the playard, the bassinet accessory comprising:

a bottom panel:

a mattress support structure irremovably coupled to the bottom panel of the bassinet accessory, the mattress support structure comprising at least two elongate stiffeners irremovably attached to the bottom panel of the bassinet accessory; and wherein the bottom panel comprises an access hole disposed between a first elongated stiffener and a second elongated stiffener of the at least two elongated stiffeners and providing a passageway through the bottom panel; and a mattress having a top side defining a sleeping surface and removably positioned over the bottom panel of the bassinet accessory and the mattress support structure;

wherein the playard and bassinet accessory are configured to be adjusted together from an assembled, in-use configuration to a disassembled, folded up, storage configuration at the same time with the bassinet accessory still coupled to the playard and mattress support structure irremovably coupled to the bottom panel of the bassinet, and wherein, when the playard and the bassinet accessory are in the disassembled, folded up, storage configuration with the bassinet accessory still coupled to the playard, the mattress wraps around the playard and the bassinet accessory and defines an outer surface of a folded up child containment device and wherein the mattress support structure folds up and fits entirely inside of the mattress defining the outer surface and within dimensions of the folded up child containment device.

* * * * *